US009470385B1

(12) United States Patent
Ploucher et al.

(10) Patent No.: US 9,470,385 B1
(45) Date of Patent: Oct. 18, 2016

(54) SOLAR LIGHT

(71) Applicant: AFMODEL, LLC., Odessa, FL (US)

(72) Inventors: Raymond A. Ploucher, Odessa, FL (US); Michael Gilmore, Tampa, FL (US)

(73) Assignee: AFMODEL, LLC., Odessa, FL (US)

( * ) Notice: Subject to any disclaimer, the term of this patent is extended or adjusted under 35 U.S.C. 154(b) by 0 days.

(21) Appl. No.: 14/749,089

(22) Filed: Jun. 24, 2015

Related U.S. Application Data

(60) Provisional application No. 62/031,262, filed on Jul. 31, 2014, provisional application No. 62/135,634, filed on Mar. 19, 2015.

(51) Int. Cl.

| | |
|---|---|
| ***F21S 8/00*** | (2006.01) |
| ***F21S 10/00*** | (2006.01) |
| ***B63B 59/02*** | (2006.01) |
| ***B63B 45/04*** | (2006.01) |
| ***F21V 33/00*** | (2006.01) |
| ***F21S 9/03*** | (2006.01) |
| ***F21S 4/00*** | (2016.01) |
| ***F21V 19/00*** | (2006.01) |
| ***F21V 23/00*** | (2015.01) |
| ***F21V 23/04*** | (2006.01) |
| *F21Y 103/00* | (2016.01) |
| *F21W 111/047* | (2006.01) |
| *F21W 111/04* | (2006.01) |

(52) U.S. Cl.

CPC ..... *F21S 10/002* (2013.01); *B63B 45/04* (2013.01); *B63B 59/02* (2013.01); *F21S 4/008* (2013.01); *F21S 8/03* (2013.01); *F21S 9/037* (2013.01); *F21V 19/0015* (2013.01); *F21V 23/001* (2013.01); *F21V 23/0464* (2013.01); *F21V 33/0064* (2013.01); *F21W 2111/04* (2013.01); *F21W 2111/047* (2013.01); *F21Y 2103/003* (2013.01)

(58) Field of Classification Search

CPC ..... F21S 4/003

USPC ..... 362/145, 183, 217.1, 648, 249.01, 362/249.02, 367

See application file for complete search history.

(56) References Cited

U.S. PATENT DOCUMENTS

| | | | |
|---|---|---|---|
| 5,148,356 | A | 9/1992 | Freese et al. |
| D378,143 | S | 2/1997 | Kollins |
| 6,031,468 | A | 2/2000 | Tsao et al. |
| 6,604,840 | B2 | 8/2003 | Watson |
| 7,044,616 | B2 | 5/2006 | Shih |
| 7,320,631 | B1 | 1/2008 | Distefano et al. |
| 7,357,527 | B2 | 4/2008 | Meyers et al. |
| 7,422,348 | B1 | 9/2008 | Yates, II |
| 7,585,085 | B1 | 9/2009 | Holman |
| 7,654,684 | B1 | 2/2010 | Wight et al. |
| D616,137 | S | 5/2010 | Bucher et al. |
| 7,748,863 | B1 | 7/2010 | Holman et al. |
| D639,479 | S | 6/2011 | Cortes et al. |
| D678,573 | S | 3/2013 | Lane |
| 8,459,826 | B2 | 6/2013 | Holman et al. |
| 2005/0174776 | A1 | 8/2005 | Althaus |
| 2006/0050528 | A1 | 3/2006 | Lyons et al. |
| 2006/0133083 | A1 | 6/2006 | Gelbert |
| 2006/0274521 | A1 | 12/2006 | Ullrich |
| 2007/0017131 | A1 | 1/2007 | Visotcky et al. |
| 2007/0159817 | A1 | 7/2007 | Evans et al. |
| 2007/0230166 | A1 | 10/2007 | Gelbert |
| 2007/0236924 | A1 | 10/2007 | Personius et al. |

*Primary Examiner* — Vip Patel

(74) *Attorney, Agent, or Firm* — Frijouf, Rust & Pyle, P.A.

(57) ABSTRACT

An illuminating device is disclosed for projecting an electromagnetic radiation. The device includes a base having a first mounting leg and a second mounting leg extending in any generally descending orientation. The first mounting leg and the second mounting leg are positioned on opposing sides of an object. The base removably engages with a power source, a solar panel and a light illuminating. The light illuminating device projects an electromagnetic radiation in a generally descending orientation.

28 Claims, 16 Drawing Sheets

SOLAR LIGHT

CROSS-REFERENCE TO RELATED APPLICATIONS

This application claims benefit of U.S. Patent Provisional application No. 62/031,262 filed Jul. 31, 2014. All subject matter set forth in provisional application No. 62/031,262 is hereby incorporated by reference into the present application as if fully set forth herein.

This application claims benefit of U.S. Patent Provisional application No. 62/135,634 filed Mar. 19, 2015. All subject matter set forth in provisional application No. 62/135,634 is hereby incorporated by reference into the present application as if fully set forth herein.

BACKGROUND OF THE INVENTION

1. Field of the Invention

This invention relates to illuminating devices and more particularly to a solar light.

2. Background of the Invention

Aids to Navigation (ATONS) comprise floating and fixed channel markers which may be lit or unlit to aid a vessel operator in safely transiting waterways. For daytime navigation, ATONS bear numerical, color and alpha identifiers enabling the navigator to determine his position in addition to being able to safely navigate. Night navigation presents a new set of problems for the navigator. Not all ATONS are lit. Those that are lit provide only an indicator light with a color and light characteristics such as repetition rate and the like.

Unlit ATONS comprise floating buoys and fixed markers. These ATONS contain dayboards having numerical, color and alpha identifiers thereon. Although the dayboards contain highly reflective coatings to enable a navigator to identify them, the need to frequently shine a light to illuminate the ATON is both inconvenient and deleterious to the night vision of the navigator.

Private ATONS are established and maintained by persons other than the U.S. Coast Guard and generally found on back waters, entrances to marinas and the like. These ATONS are rarely lit, yet identify channels which must be properly navigated. It is an obvious conclusion that illumination of the dayboards of all these ATONS would be of great benefit to the navigator Illumination of ATON dayboards is quite similar to the need for illumination of other various signs such as real estate signs and the like. The effectiveness of an illuminated sign versus an unlit sign is undisputable. The need for a means of illuminating dayboards and signs with an easily installed lighting assembly requiring minimum maintenance, and easily replaceable components has been well established.

There have been many in the prior art who have attempted to solve these problems with varying degrees of success. None, however completely satisfies the requirements for a complete solution to the aforestated problem. The following U.S. Patents are attempts of the prior art to solve this problem.

U.S. Pat. No. 5,148,356 to Freese, et al. discloses a crib light having front and rear housing portions which cooperate to clamp the light to a horizontal rail of a crib. The rear housing portion may be removed to permit the front housing portion to be mounted flush to a vertical wall surface. In addition, a lens cover is provided adjacent to a light emitting aperture of the front housing portion for controlling the brightness of light emitted. A control circuit is further provided for automatically shutting the light off after a predetermined interval of time.

U.S. Pat. No. 6,301,468 to Tsao, et al. discloses a warning light to be coupled to a stop sign. The warning light includes a main unit, a holder for cooperating with the main unit to couple to the stop sign, a solar cell for converting solar energy into electrical energy, a light emitting element disposed in the main unit, an energy storage device coupled to the solar cell for storing the electrical energy, and a charge control circuit coupled to the solar cell, energy storage device and light emitting element. The charge control circuit selectively directs electrical energy from the solar cell to energy storage device, or from the energy storage device to the light emitting element.

U.S. Pat. No. 6,604,840 to Watson discloses a lighting apparatus for use with a name plate sign including an elongate frame having a planar bottom with an upper portion defining an interior space. The frame bottom includes a bracket for attachment to the name plate. A rechargeable battery is mounted within the interior space of the frame and is electrically connected to a plurality of light sources depending from the frame bottom. A thin film solar panel is positioned atop the upper frame portion and is electrically connected to the battery to repeatedly recharge it as the panel collects solar energy. A photoelectric light sensor is mounted to the frame and permits current to flow from the battery to the light sources when a sensed level of ambient light is less than a predetermined level. Therefore, the name plate is illuminated when insufficient ambient light is available.

U.S. Pat. No. 7,044,616 to Shih discloses a solar powered warning light device including a housing having a front orifice, a solar panel disposed on top of the housing to receive solar energy, a circuit board disposed in the housing and having a converting device coupled to the solar panel, to receive and to convert the solar energy into electric energy and stored in one or more capacitors. The circuit board includes one or more light devices coupled to and energized by the capacitor, and engaged in the orifice of the housing, to emit light out of the housing. A switch may switch on and off the light device, and a photoactive member is coupled to the electric switch, to operate the electric switch by the light of the environment.

U.S. Pat. No. 7,320,631 to Distefano, et al. discloses a nautical light emitting diode ("LED") safety channel marker that is cylindrical in shape, capable of displaying lighted oceanic regulation symbols on either side, and that at night illuminates the panels that display a red triangle and a green square through the use of LEDs that surround the perimeter of the square and triangle in order to more effectively prevent boats from colliding with the markers during the darkness hours.

U.S. Pat. No. 7,357,527 to Meyers, et al. discloses a mountable lighting module that uses solar energy to charge a power source for LEDs used in night illumination of both sides of a double-faced sign. The mountable lighting module comprises a housing for the electronics conjoined with a clamp for mounting to a sign support and a pair of sign illuminating members with each extending over opposing sides of the sign directly illuminating the sign's copy area.

U.S. Pat. No. 7,422,348 to Yates, I I discloses a lighting apparatus preferably for use with a removable frame sign including a light canopy for illuminating the sign when ambient light is less than a predetermined level. The light canopy easily attaches to the frame and illuminates the surfaces of the sign through an arrangement of a plurality of light sources positioned in elongated recesses. The light sources are electrically connected with a rechargeable battery, light sensor, and a solar panel. The solar panel contained in the light canopy is protected and covered by a translucent cover. The lighting apparatus can be readily removed from the sign to allow for interchangeability of the signage and extends the time period for sign visibility during low levels of ambient light.

U.S. Pat. No. 7,585,085 to Holman discloses embodiments of a solar lighting apparatus and method.

U.S. Pat. No. 7,654,684 to Wight, et al. discloses a solar-rechargeable light fixture. A preferred embodiment is adapted for attachment to the horizontal cross-bar of a yard-mounted real estate sign effective to illuminate both sides of the sign after dark. The light fixture includes a solar panel adapted to charge a battery which powers a plurality of lights, such as incandescent bulbs or LEDs. Sometimes, a microprocessor is included in-circuit to control operation of the light fixture, and may also provide diagnostic feedback to a user. Desirably, the light fixture can be switched into a storage mode to avoid discharge of the battery during periods of non-use.

U.S. Pat. No. 7,748,863 to Holman, et al. discloses a sign light to illuminate a sign such as a real estate sale sign. The sign light is configured to suspend between the crossarm of a sign post and the sign. The sign light includes a housing, a light source, and sign mounting hardware. The housing allows the sign light to suspend from a crossarm of a sign post. The housing includes an internal compartment. The light source is located within the internal compartment of the housing. The sign mounting hardware is directly coupled to the housing to provide a mounting location for a sign to hang from the mounting hardware. The housing and mounting hardware facilitate suspending the sign light between the crossarm of the sign post and the sign.

U.S. Pat. No. 8,459,826 to Holman, et al. discloses a lighting apparatus including a housing, a light source, and sign mounting hardware. The housing includes a top surface which is also a top surface of the entire lighting apparatus. The top surface of the lighting apparatus includes attachment means for coupling the lighting apparatus to light mounting hardware to suspend the lighting apparatus from a bottom surface of a crossarm of a sign post in a mounted position, so that the entire lighting apparatus suspends below a bottom surface of the crossarm of the sign post in the mounted position. The light source is within an internal compartment of the housing. The sign mounting hardware is coupled to the housing. The sign mounting hardware is configured to suspend a sign from the lighting apparatus, so that the entire sign suspends below the lighting apparatus in the mounted position.

U.S. Design Pat. No. D378,143 to Kollins discloses a design for a portable solar powered yard sign light, as shown and described.

U.S. Design Pat. No. D616,137 to Bucher, et al. discloses an ornamental design for a sign light device, as shown and described.

U.S. Design Pat. No. D639,479 to Cortes, et al. discloses an ornamental design for a sign illuminating device, as shown and described.

U.S. Design Pat. No. D678,573 to Lane discloses an ornamental design for a solar powered basketball rim illuminator, as shown and described.

United States Patent Application 2005/0174776 to Althaus discloses a light of an apparatus for illumination of a sign. The sign is part of a unit which can be attached permanently to the existing sign and contains a power supply which is independent of the mains. In addition to the illumination of the sign, a further light may also illuminate a surrounding area, for example, areas of footpaths and roads.

United States Patent Application 2006/0050528 to Lyons, et al. discloses a real estate sign post having a crossbar on which a modular lighting unit is secured by two theft-resistant screws having non-circular holes in their heads and shielded by upstanding walls on mounting brackets. The lighting unit is enclosed in a box-like housing with a solar panel in the top side, slot-like lamp openings at opposite ends of the bottom side, and elongated arrays of LED's mounted in concave reflectors for directing light toward opposite sides of a real estate sign. Battery packs enclosed in shrink wrap and a controller are enclosed in the housing. An alternative embodiment mounts fluorescent bulbs in reflectors that are supported on opposite sides of a base unit by elongated arms.

United States Patent Application 2006/0133083 to Gelbert discloses a sign assembly including a fixture capable of being attached to a sign support structure. The sign assembly also includes a canopy which can slideably engage the fixture to provide cover for the sign support structure. The canopy can be foldable and can include lights to illuminate a sign held by the sign support structure. The lights can be provided power through contacts which are engaged when the canopy is attached to the fixture.

United States Patent Application 2006/0274521 to Ulrich discloses a lighting device connectable to a horizontal arm of a realty sign post for directing light to both sides of the sign. The device includes a mounting structure and an upper housing. The device is actuated by a polar rechargeable batter disposed in the housing. Solar panels are connected to an arcuate surface of the upper housing of the device and electrically connected to the battery and a series of LED lights fitted along a pair of cavities in the mounting structure. The lighting device is attached to the realty sign post by pivotal arms that selectively secure around the horizontal arm.

United States Patent Application 2007/0017131 to Visotcky, et al. discloses a lighting system for a real estate sign comprising an elongated illumination arm, a light source, an attachment housing, a power supply, and means for removably attaching the attachment housing to a real estate sign. The light source is connected to one end of the illumination arm, and the power supply is connected to another end. The lighting system may further have a switch to interrupt and reestablish the electrical communication between the power supply and the light source. In a version of the invention, the illumination arm is articulable and may be bent to direct light from the light source toward the sign.

United States Patent Application 2007/0159817 to Evans, et al. discloses a device for illuminating a yard sign that uses an efficient beam of light and is adapted to cycle on and off. The illuminating device includes a main body portion, a switch, a control circuit, a power source, at least one arm adjustably attached to the main body portion, and a light head disposed proximate an end of the at least one arm, the light head comprising at least one light emitting diode (LED) assembly. The control circuit is configured to automatically cycle the LED assembly on and off when activated by the switch.

United States Patent Application 2007/0230166 to Gilbert discloses a sign assembly including a fixture capable of being attached to a sign support structure. The sign assembly also includes a canopy which can slideably engage the fixture to provide cover for the sign support structure. The canopy can be foldable and can include lights to illuminate a sign held by the sign support structure. The lights can be provided power through contacts which are engaged when the canopy is attached to the fixture.

United States Patent Application 2007/0236924 to Personius, et al. discloses one possible embodiment of the invention which could be signage illumination apparatus comprising a body, the body having generally an inverted U-shaped cross section substantially forming a channel that allows the device to straddle a support arm of a yard signage. The body generally supports electronic circuitry that is substantially electrically connected to solar power cell(s), a rechargeable electrical storage device(s) and an illumination source(s). When light is generally energizing the solar power cell(s), the electronic circuitry may cause the resultant current from the solar power cell(s) to generally charge the rechargeable electrical power source(s) and not power the illumination device(s). When light is not generally energizing the solar panel(s), the electronic circuitry board may cause the charged rechargeable electrical power source (s) to discharge and power the illumination device(s) to illuminate at least a portion of the yard signage.

Although the aforementioned prior art have contributed to the development of the art illuminating signs and the like, none of these prior art patents have solved the needs of this art.

Therefore, it is an object of the present invention to provide an improved apparatus for illuminating ATON dayboards and signs.

Another object of this invention is to provide an improved apparatus that is simple for the operator to install on existing dayboards or signs.

Another object of this invention is to provide an improved apparatus that is relatively maintenance free.

Another object of this invention is to provide an improved apparatus that is simple replace defective or failed components.

Another object of this invention is to provide an improved apparatus that is easy to cost effectively produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

A specific embodiment of the present invention is shown in the attached drawings. For the purpose of summarizing the invention, the invention relates to an improved device for illumination. The illuminating device comprises a base extending between a proximal end and a distal end. A first mounting leg and a second mounting leg extend from the base in a generally descending orientation. A mounting channel is defined between the first mounting leg and the second mounting leg for positioning on opposing sides of an object A base channel is defined in the base. A power source is removably engaged within the base channel. An upper track is coupled to the base and has a generally ascending orientation. A solar panel is being removably engaged within the upper track. A first electrical conduit electrically couples the power source with the solar panel for recharging the power source. A lower track is coupled to the base and having a generally descending orientation. A light illuminating device is removably engaged within the lower track. A second electrical conduit electrically couples the power source with the light illuminating device for supplying current to the light illuminating device. The light illuminating device projects an electromagnetic radiation in a generally descending orientation.

In one embodiment of the invention, the upper track defines an offset orientation relative to the mounting channel. A second upper track is coupled to the base and has a generally ascending orientation. The second upper track defines a non-offset orientation relative to the mounting channel. A second solar panel is removably engaged within the second upper track. A third electrical conduit electrically couples the power source with the second solar panel for recharging the power source.

In another embodiment of the invention, the upper track defines a first offset orientation relative to the mounting channel. A second upper track is coupled to the base and has a generally ascending orientation. The second upper track defines a second offset orientation relative to the mounting channel. The upper track and the second upper track define opposite orientations. The first offset orientation and the second offset orientation are equivalent for defining a symmetrical cross-section in the base.

In another embodiment of the invention, the base, the first mounting leg, the second mounting leg, the upper track and the lower track are constructed from an integral one-piece unit. The integral one-piece unit is constructed by extruding a polymeric material through a mold.

In another embodiment of the invention, the first mounting leg extends from the base in a generally vertical orientation and the second mounting leg extends from the base in a generally horizontal orientation. A L-shaped mounting channel is defined between the first mounting leg, the base and the second mounting leg for abutting the vertical freeboard portion and the horizontal deck portion respectively. A deformable bumper extends from the base for cushioning and distancing the vessel from water platform. The deformable bumper includes a bulbous body portion. The bulbous body portion has a bulbous depth. A taper body portion extends from the first mounting leg. The taper body portion has a taper depth. The bulbous depth is greater than the taper depth for defining a cantilever in the bulbous body portion relative to the taper body portion. The lower track is coupled to the taper body portion. The cantilever protects the light illuminating device upon the vessel contacting the bulbous body portion.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
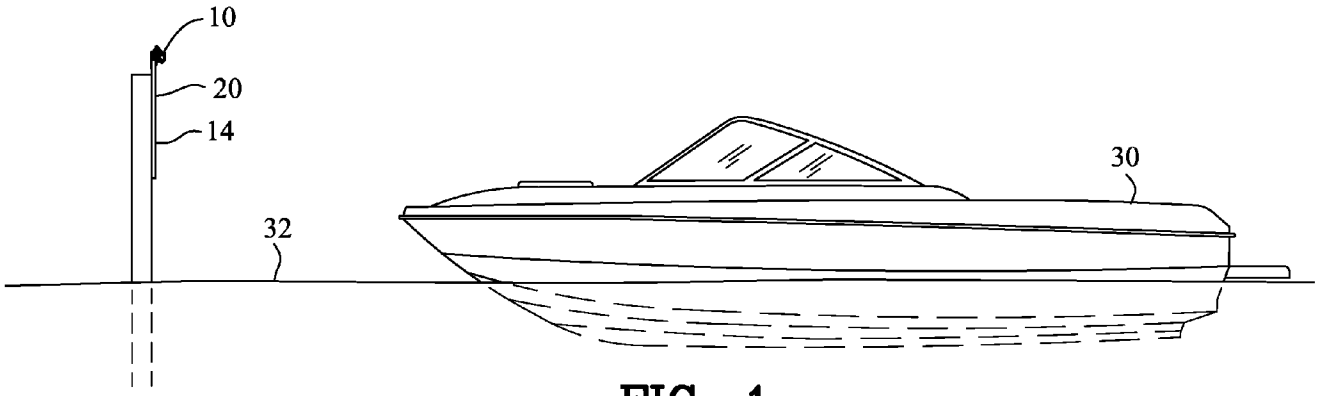
FIG. 1 is an elevated view of a first embodiment for an illuminating device for illuminating a channel marker and assisting in the navigation of a vessel at night.

FIGS. 1-16 illustrate an illuminating device 10 for projecting an electromagnetic radiation 12 onto an object 14. In FIGS. 1-6 the object 14 is illustrated as including a marine channel marker 20. Alternatively, in FIGS. 10-12 the object 14 is illustrated as including a two sided advertising sign 40. It should be understood that the object 14 may include many other types of objects that require illumination.

FIGS. 1-9, 13 and 15 illustrate a first embodiment of the present invention. FIGS. 10-12, 14 and 16 illustrate a second embodiment of the present invention. As best shown in FIGS. 4-9 in the first embodiment and FIGS. 10-12 in the second embodiment, the illuminating device 10 includes a base 60 extending between a proximal end 62 and a distal end 64. A first mounting leg 66 and a second mounting leg 68 extend from the base 60 in a generally descending orientation 70.

Figure 6:
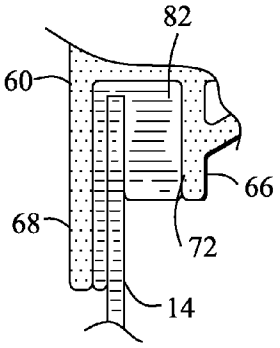
FIG. 6 is a partial view of the illuminating device of FIG. 4 illustrating a second channel marker engaging a mounting insert between the illuminating device and the second channel marker.
Figure 4:
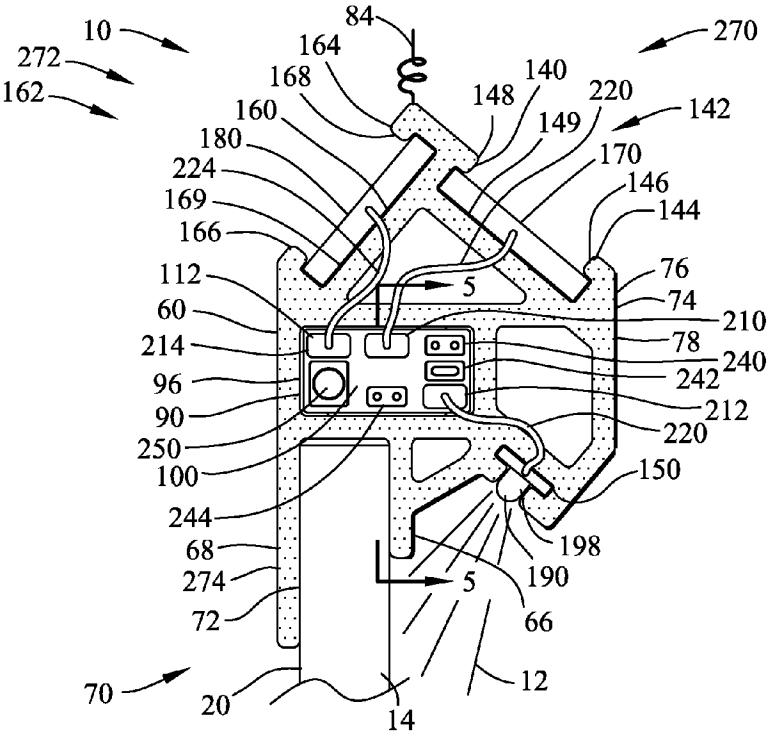
FIG. 4 is an enlarged view of a portion of FIG. 1 illustrating both the illuminating device and the channel marker.
Figure 5:
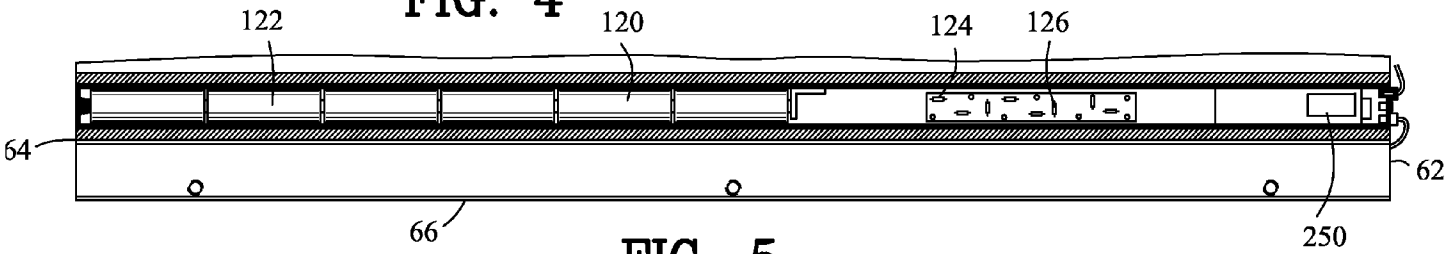
FIG. 5 is a sectional view along line 5-5 in FIG. 4.
Figure 7:
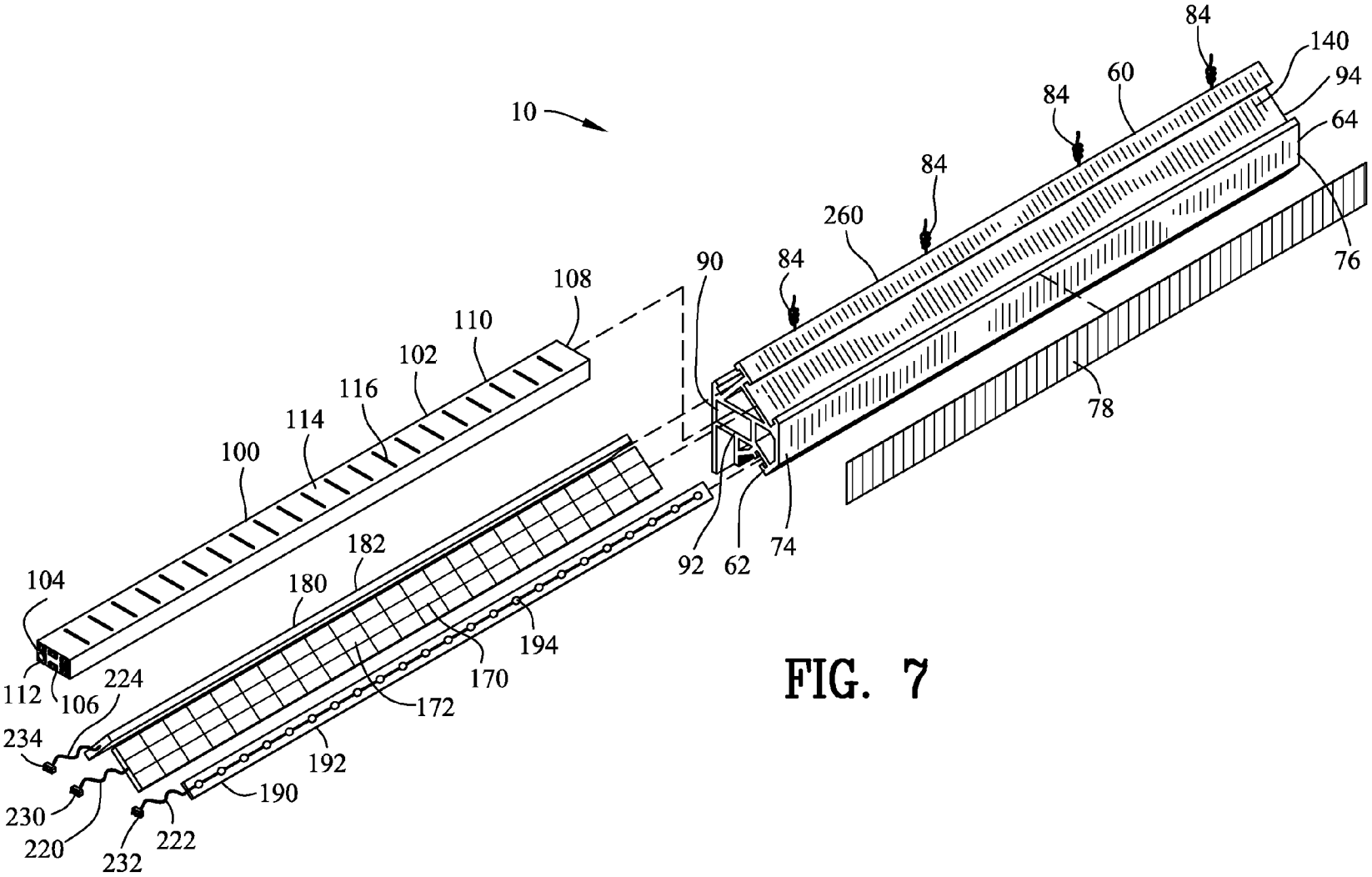
FIG. 7 is an exploded isometric view of the illuminating device of FIG. 4.
Figure 8:
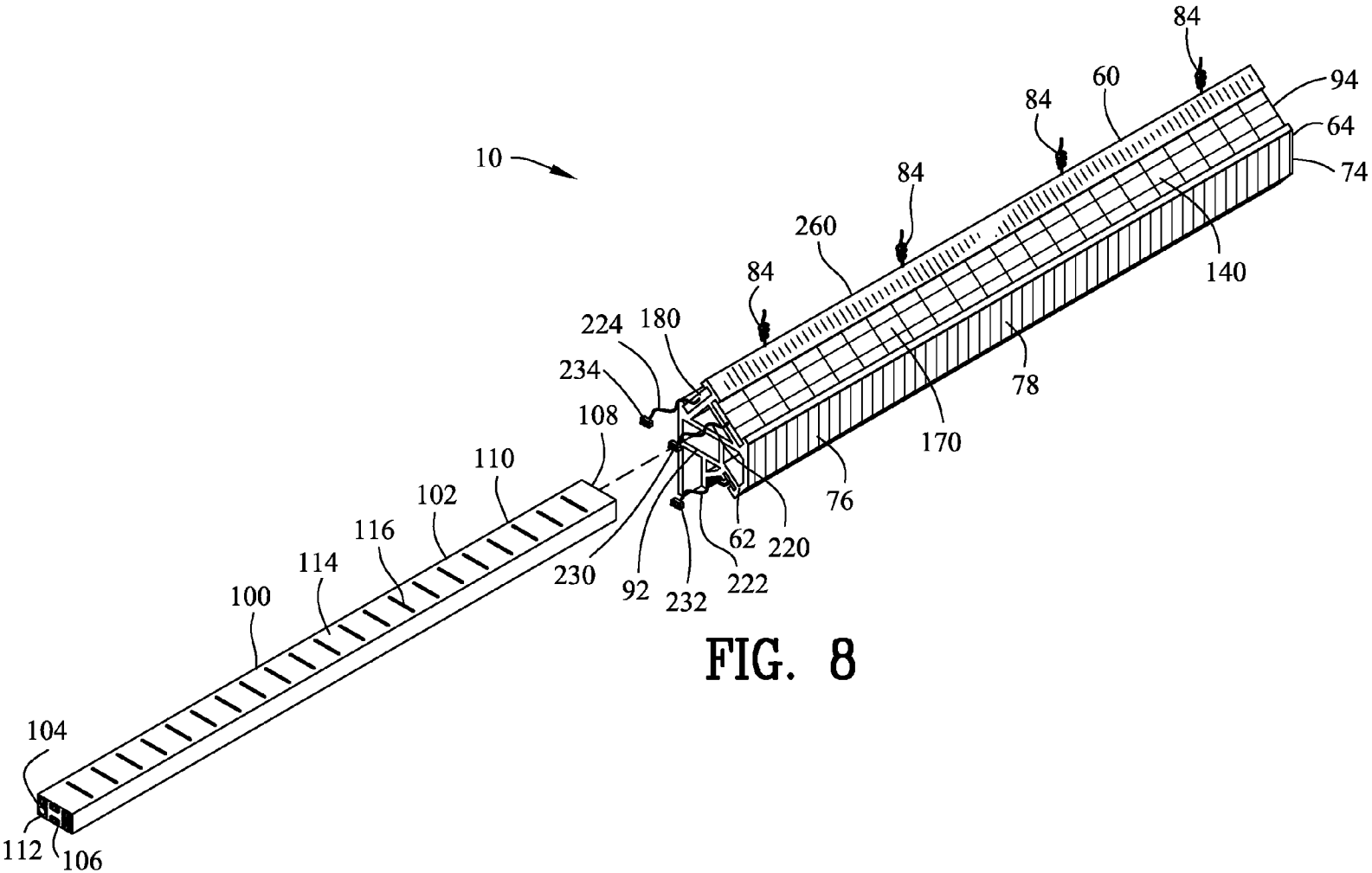
FIG. 8 is a view similar to FIG. 7 illustrating a solar panel, a second solar panel and a light illuminating device engaging within an upper track, a second upper track and a lower track respectively.
Figure 9:
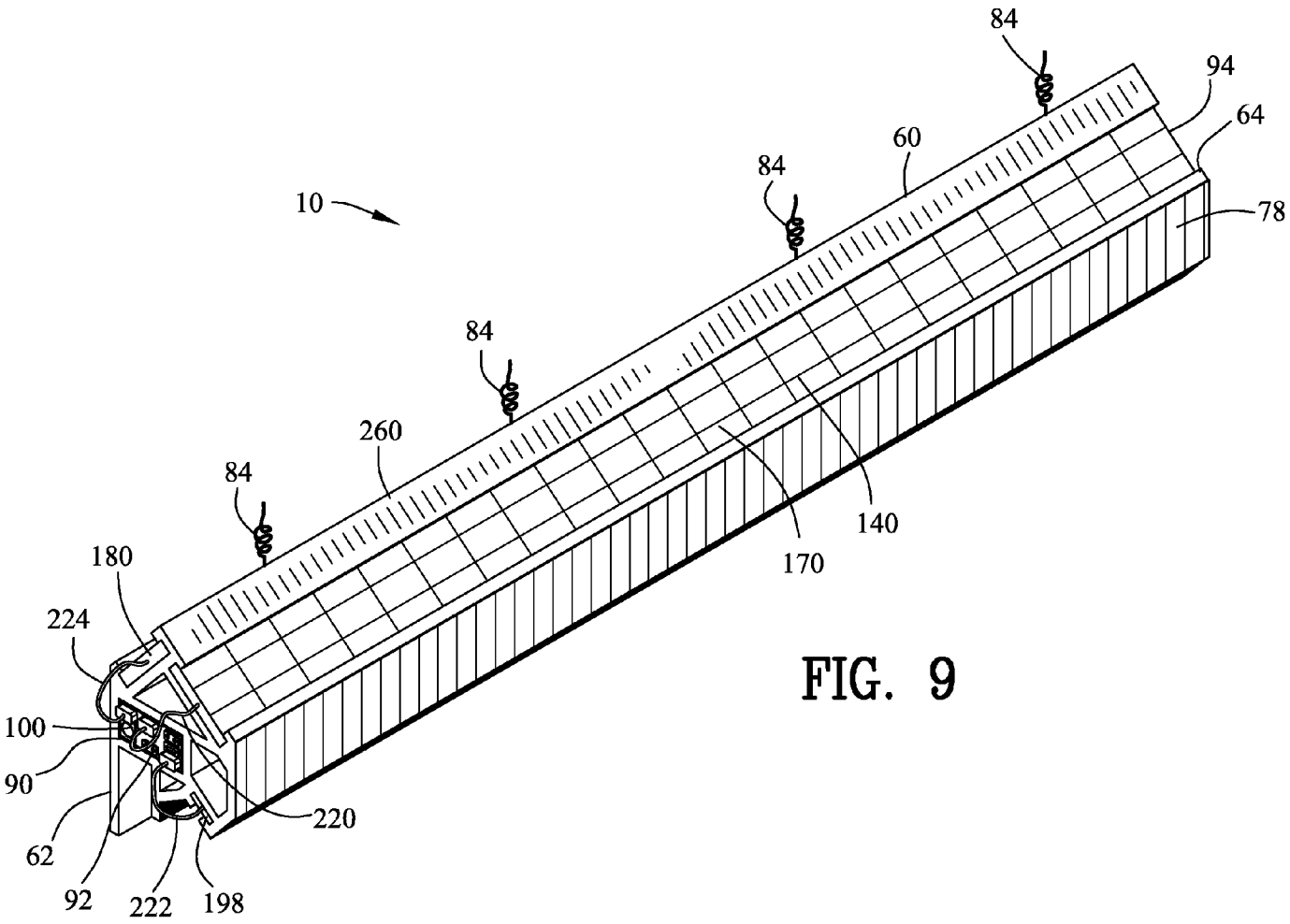
FIG. 9 is a view similar to FIG. 8 illustrating a power source engaging within a base channel.
Figure 12:
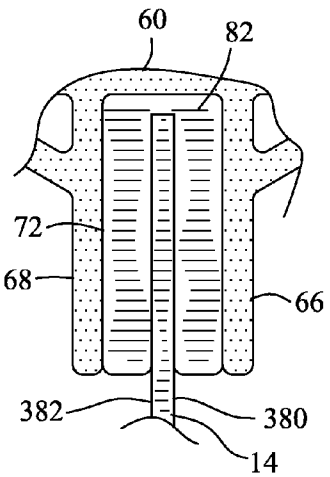
FIG. 12 is a partial view of the illuminating device of FIG. 11 illustrating a second sign engaging a mounting insert between the illuminating device and the second sign.
Figure 11:
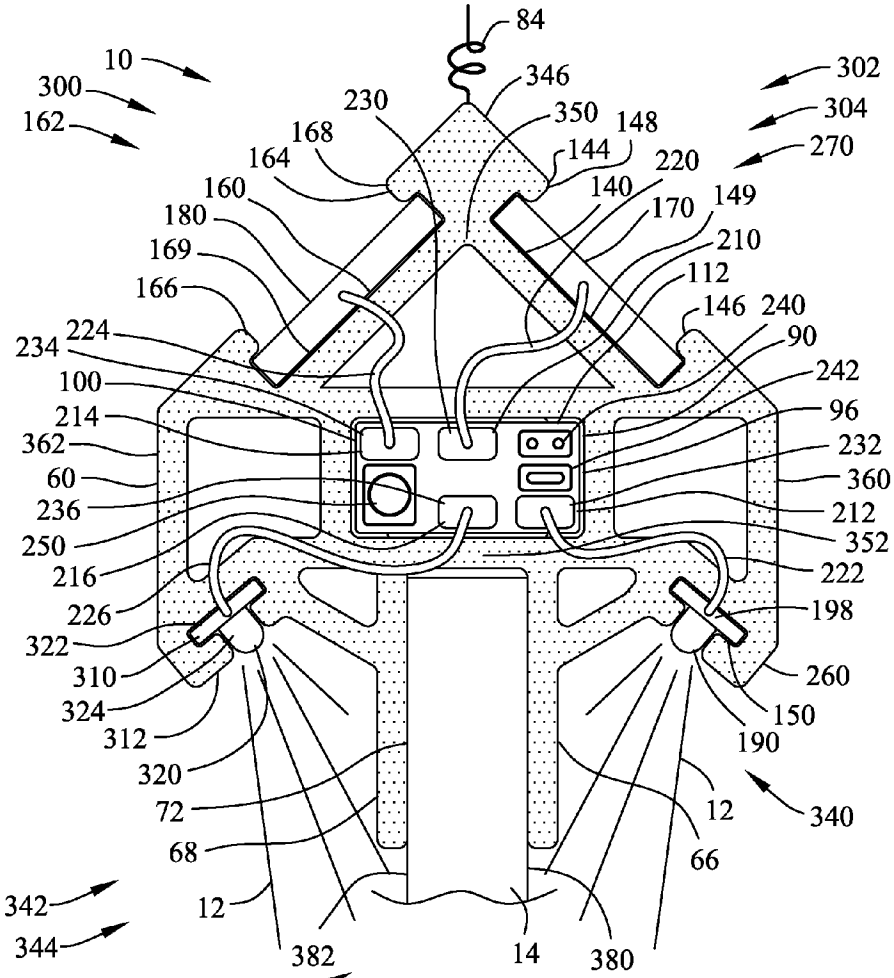
FIG. 11 is an enlarged end view of a portion of FIG. 10 illustrating both the illuminating device and the sign.

A mounting channel 72 is defined between the first mounting leg 66 and the second mounting leg 68 for positioning on opposing sides of the channel marker 20. As shown in FIGS. 4 and 11, preferably the distance between the first mounting leg 66 and the second mounting leg 68 is commensurate with the depth of the object 14. As shown in FIGS. 6 and 12, if the depth of the object 14 is less than the distance between the first mounting leg 66 and the second mounting leg 68, a depth adjustment insert 82 may be utilized for matching the dimension of the mounting channel 72. The first mounting leg 66 and the second mounting leg 68 may be further secured to the object 14 by fasteners, adhesive or other coupling devices.

The base 60 further includes a base channel 90. Preferably, the base channel 90 extends between the proximal end 62 and the distal end 64 of the base 60. The base channel 90 defines a proximal aperture 92 and a distal aperture 94. The base channel 90 is shown as including a rectangular shaped cross-section 96. However, the base channel 90 may include other geometric cross-sectional shapes.

As shown in FIGS. 4, 5 and 7-11, a power source 100 is removably engaged within the base channel 90. The power source 100 is preferably constructed of an elongated housing 102 having a rectangular shaped cross-section 104 and extending between a proximal end 106 and a distal end 108. The distal end 108 of the elongated housing 102 includes a sealed enclosure 110. The proximal end 106 of the elongated housing 102 includes an electrical interface 112. Preferably, the rectangular shaped cross-section 104 of the power source 100 is commensurate to the rectangular shaped cross-section 96 of the base channel 90 for preventing rotational displacement of the elongated housing 102 relative to the base channel 90. The elongated housing 102 may be contracted of a polymeric material or other noncorrosive materials. The elongated housing 102 includes an upper surface 114 having a plurality of ripped casting 116 for abutting against an upper surface 98 of the base channel 90. The plurality of ripped casting 116 prevent the inadvertent linear displacement of the elongated housing 102 from the base channel 90. The power source 100 can be easily installed or easily replaced if damaged by having the power source 100 being removably engaged within the base channel 90.

Internal to the elongated housing 102 is a battery chamber 120 for receiving a plurality of rechargeable batteries 122. An electrical circuit 124 couples the plurality of rechargeable batteries 122 to a circuit board 126 and to the electrical interface 112.

An upper track 140 is coupled to the base 60. The upper track 140 has a generally ascending orientation 142. A lower track 150 is coupled to the base 60 and has a generally descending orientation 152. Preferably, the upper track 140 and the lower track 150 defining a generally C-shape cross-section 144 and 154, respectively. More specifically, the general C-shape cross-section 144 of the upper track 140 includes a primary arm 146 and a secondary arm 148 that is coupled by a track wall 149. The general C-shaped cross-section 154 of the lower track 150 includes a primary arm 156 and a secondary arm 158 that is coupled by a track wall 159.

A second upper track 160 is coupled to the base 60 and has a generally ascending orientation 162. Preferably, the second upper track 160 defines a generally C-shape cross-section 164. More specifically, the general C-shape cross-section 164 of the second upper track 160 includes a primary arm 166 and a secondary arm 168 that is coupled by a track wall 169.

A solar panel 170 is removably engaged within the upper track 140. The solar panel 170 preferably has an elongated configuration 172 for extending between the proximal end 62 and the distal end 64 of the base 60. More specifically, the solar panel 170 engages within the general C-shaped cross-section 144 wherein the primary arm 146 and the secondary arm 148 of the upper track 140 maintains the solar panel 170 adjacent to the track wall 149. The solar panel 170 can be easily installed or easily replaced if damaged by having the solar panel 170 being removably engaged within the upper track 140.

A second solar panel 180 is removably engaged within the second upper track 160. The second solar panel 180 preferably has an elongated configuration 182 for extending between the proximal end 62 and the distal end 64 of the base 60. More specifically, the second solar panel 180 engages within the general C-shaped cross-section 164 wherein the primary arm 166 and the secondary arm 168 of the second upper track 160 maintains the second solar panel 180 adjacent to the track wall 169. The second solar panel 180 can be easily installed or easily replaced if damaged by having the second solar panel 180 being removably engaged within the second upper track 160.

Figure 2:
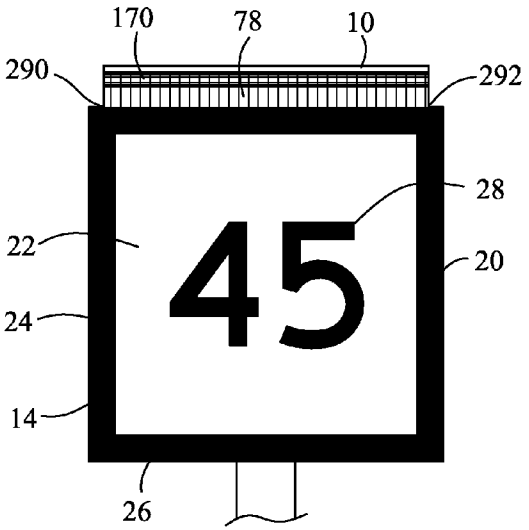
FIG. 2 is a front view of the channel marker of FIG. 1.
Figure 3:
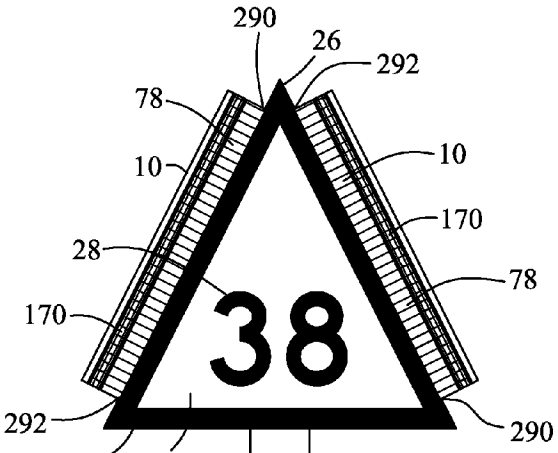
FIG. 3 is a view similar to FIG. 2 illustrating the illuminating device engaging a triangular channel marker.
Figure 10:
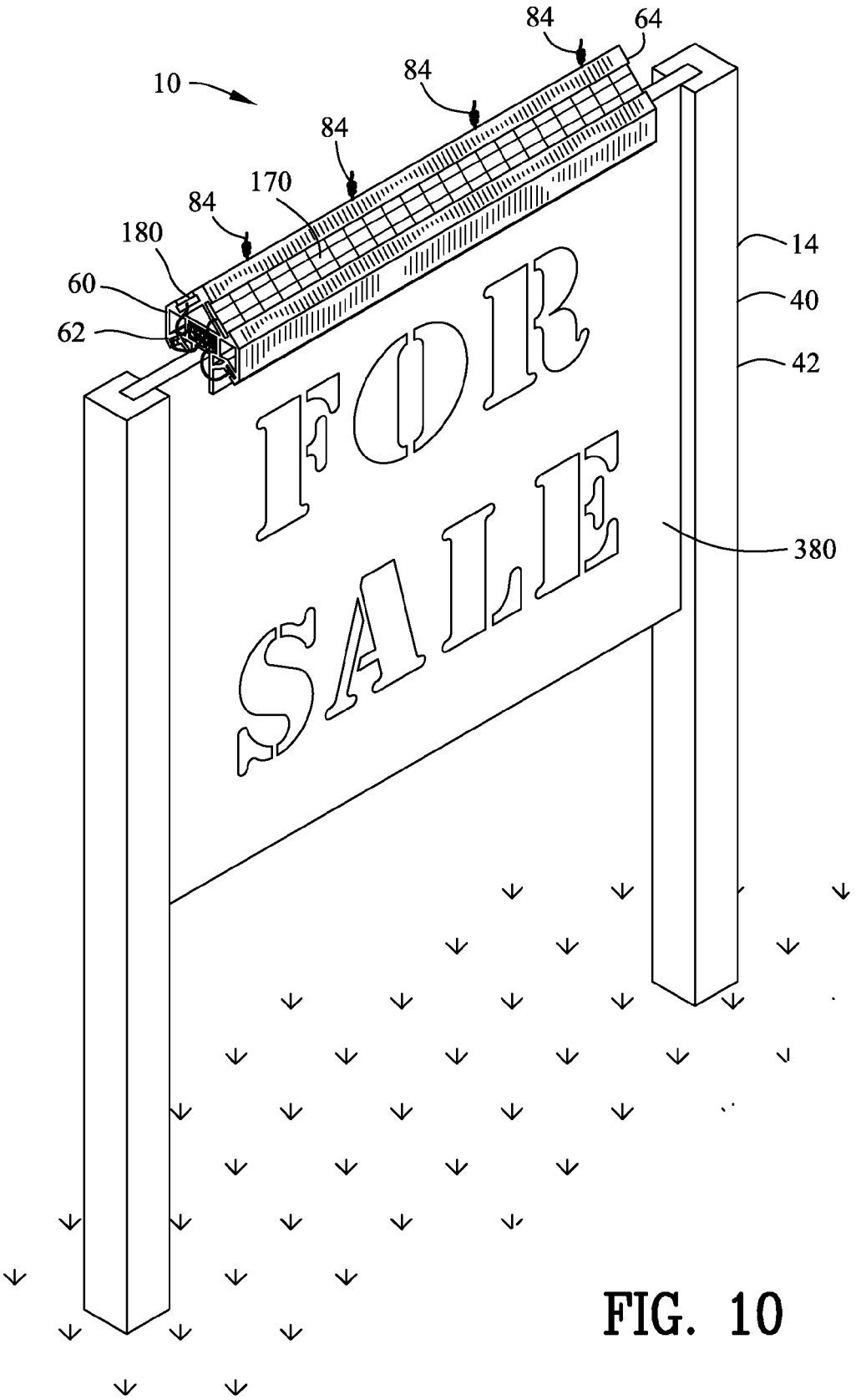
FIG. 10 is a second embodiment for an illuminating device for illuminating a sign for and assisting in viewing the sign at night.

A light illuminating device 190 is removably engaged within the lower track 150. The light illuminating device 190 preferably has an elongated configuration 192 for extending between the proximal end 62 and the distal end 64 of the base 60. More specifically, the light illuminating device 190 engages within the general C-shaped cross-section 154 wherein the primary arm 156 and the secondary arm 158 of the lower track 150 maintains the light illuminating device 190 adjacent to the track wall 159. The light illuminating device 190 can be easily installed or easily replaced if damaged by having the light illuminating device 190 being removably engaged within the lower track 150. The light illuminating device 190 includes a plurality of linear light emitting diodes 194 or other illuminating devices. The light illuminating device 190 projects an electromagnetic radiation 196 in a generally descending orientation 198 for illuminating the object 14, including the marine channel marker 20 as shown in FIGS. 1-3 or the advertising sign 40 as shown in FIG. 10.

As best shown in FIGS. 4 and 11, the electrical interface 112 includes a first electrical receptacle 210, a second electrical receptacle 212 and a third electrical receptacle 214. A first electrical conduit 220 extends from the solar panel 170 and terminates with a first electrical plug power source 230. A second electrical conduit 222 extends from the light illuminating device 190 and terminates with a second electrical plug 232. A third electrical conduit 224 extends from the second solar panel 180 and terminates with a third electrical plug 234.

The first electrical conduit 220 electrically couples the power source 100 with the solar panel 170 for recharging the plurality of rechargeable batteries 122. The first electrical plug 230 engages into the first electrical receptacle 210 for permitting prompt coupling and decoupling of the power source 100 with the solar panel 170. The second electrical conduit 222 electrically couples the power source 100 with the light illuminating device 190 for supplying current to the light illuminating device 190. The second electrical plug 232 engages into the second electrical receptacle 212 for permitting prompt coupling and decoupling of the power source 100 with the light illuminating device 190. The third electrical conduit 224 electrically couples the power source 100 with the second solar panel 180 for recharging the plurality of rechargeable batteries 122. The third electrical plug 234 engages into the third electrical receptacle 214 for permitting prompt coupling and decoupling of the power source 100 with the second solar panel 180. Preferably, the engagement between the first electrical receptacle 210 with the first electrical plug 230, between the second electrical receptacle 212 with the second electrical plug 232, between the third electrical receptacle 214 with the third electrical plug 234 form a watertight engagement including but not limited to a rubber boot engagement.

The electrical interface 112 may further include a battery contact initiator receptacle 240 and a battery contact initiator plug 242. The battery contact initiator plug 242 would be stored in a non-functional receptacle 244 during storage and transportation for placing the electrical circuit 224 in an open circuit status. Upon the desire to initiate the illuminating device 10, the battery contact initiator plug 242 would be withdrawn from the nonfunctional receptacle 244 and installed into the battery contact initiator receptacle 240 for placing the electrical circuit 224 in a closed circuit status.

The elongated housing 102 may further include a photoelectric switch 250 that is electrically coupled to the electrical circuit 124. More specifically, the photoelectric switch 250 may be coupled within the second electrical conduit 222 for terminating current to the light illuminating device 190 when the photoelectric switch 250 is exposed to sunlight and permitting current to the light illuminating device 190 when the photoelectric switch 250 is not exposed to sunlight.

Figure 13:
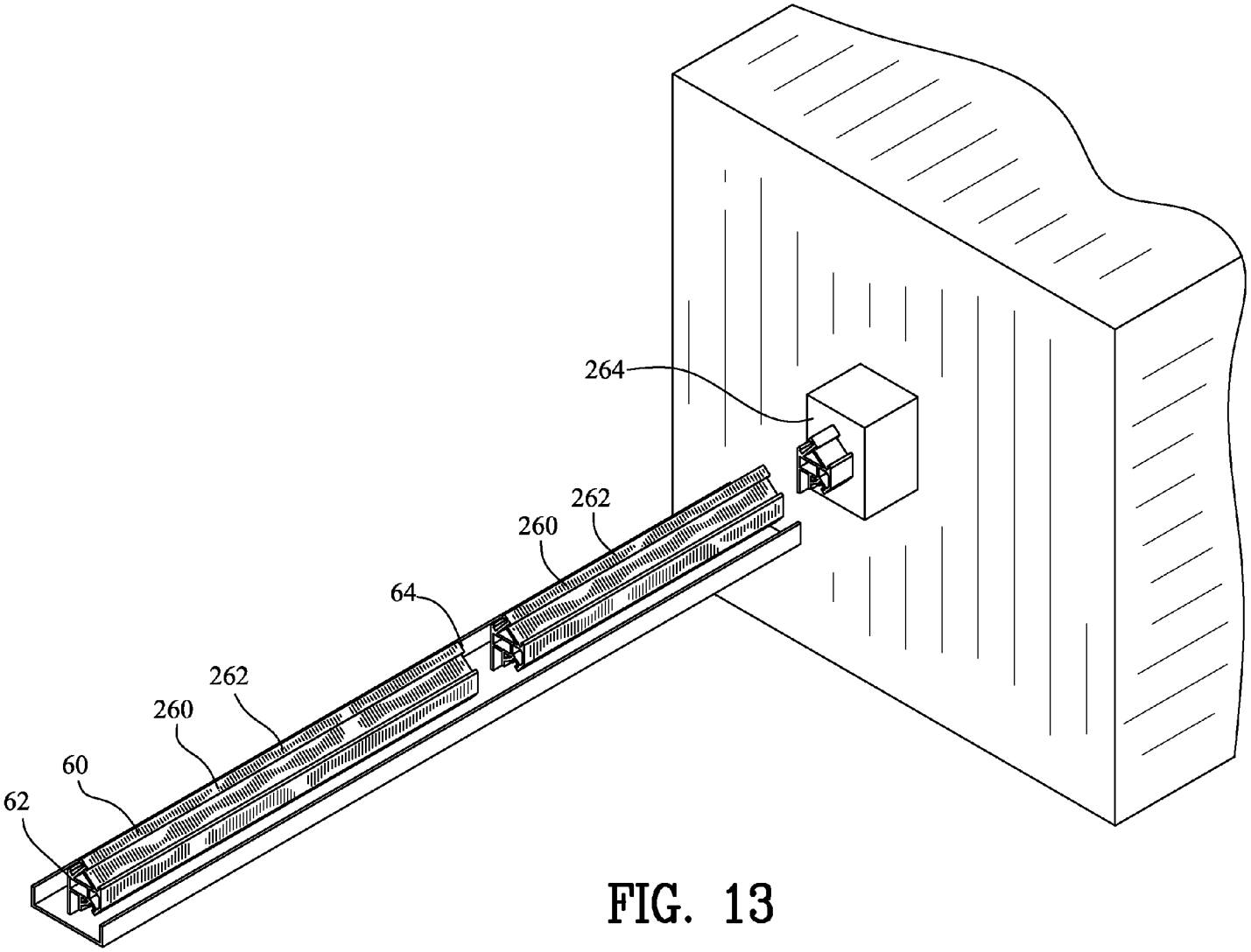
FIG. 13 is an isometric view of the illuminating device of FIG. 4 being constructed from an integral one-piece unit by extruding a polymeric material through a mold.
Figure 14:
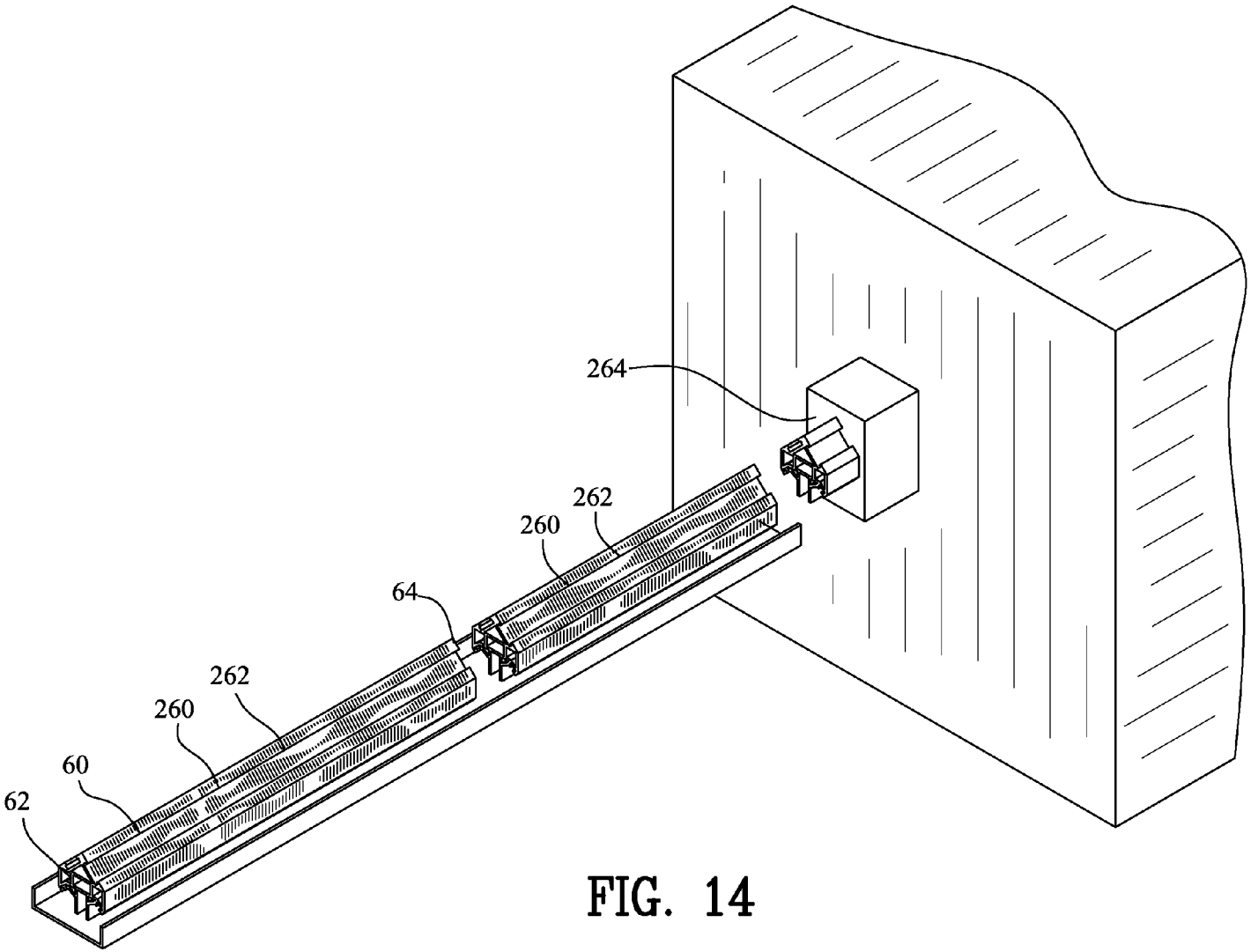
FIG. 14 is an isometric view of the illuminating device of FIG. 10 being constructed from an integral one-piece unit by extruding a polymeric material through a mold.
Figure 16:
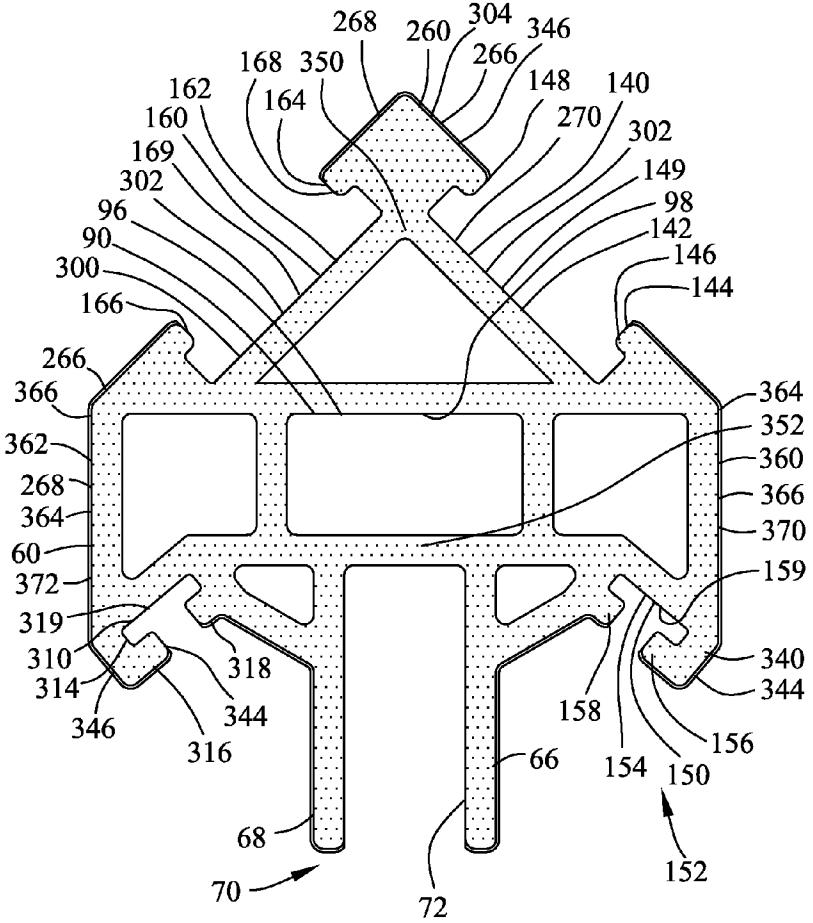
FIG. 16 is a view similar to FIG. 11 illustrating the second illuminating device including a protective layer.
Figure 15:
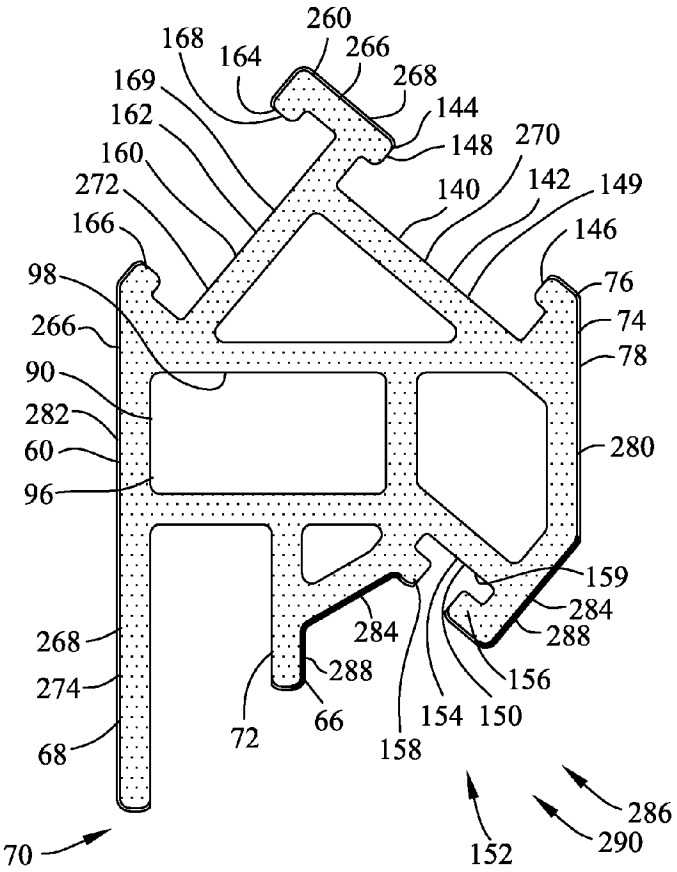
FIG. 15 is a view similar to FIG. 4 illustrating the first illuminating device including a border portion height, a reflective layer and a protective layer.

The best shown in FIGS. 13 and 14, the base 60, the first mounting leg 66, the second mounting leg 68, the upper track 140, the lower track 150 and the second upper track 160 are constructed from an integral one-piece unit 260. The integral one-piece unit 260 may be constructed by extruding a polymeric material 262 through a mold 264. Preferably, the polymeric material 262 should be selected such that the illuminating device 10 is permitted to slightly bend and twist for accommodating an object 14 that may include any warping and or twisting. Furthermore, by extruding the illuminating device 10 through the mold 264, the illuminating device 10 is able have alternative overall lengths. As shown in FIGS. 15 and 16 the base 60 may include a protective coating 266. The protective coating 266 protects the interior polymeric material 262 from deterioration from UV rays and other physical and environmental factors. The protective coating 266 may include a white pigment 268 for reflecting UV rays.

The base 60 may further include a sidewall 74 having a generally parallel orientation 76 relative to the first mounting leg 66 and the second mounting leg 68. A reflective layer 78 may be coupled to the sidewall 74 for reflecting a foreign electromagnetic radiation. The foreign electromagnetic radiation may be generated from a spotlight from a vessel, a headlight from a motor vehicle, a flashlight or other light illuminating devices.

The base 60 may further include a bird deterrent spike 84 extending from the base 60 and having a generally vertical orientation. The base 60 may include multiple bird deterrence spikes 84 position along the length of the base 60. The bird deterrent spike 84 is designed to discourage bird perching upon the top of the light illuminating device 10.

Specifically to the first embodiment in FIGS. 1-8, 13 and 15, the upper track 140 defines an offset orientation 170 relative to the mounting channel 72. Furthermore, the second upper track 160 defines a non-offset orientation 272 relative to the mounting channel 72. The offset orientation 170 in combination with the non-offset orientation to 72 permits the installation of the illuminating device 10 wherein the clearance adjacent to the second mounting leg 68 is severely restricted. More specifically, the illuminating device 10 in FIGS. 1-8, 13 and 15 provides for a generally linear edge along the second mounting leg 68.

As best shown in FIGS. 2 and 3, the channel marker 20 has an interior color 22 and a border color 24. The border color 24 has a border width 26. As best shown in FIGS. 1-4 and 15, the base 60 includes a front side 280 and a rear side 282. The front side 280 has a border portion height 284. The border portion height 284 is equivalent to the border width 26 of the channel marker 20 for defining an equivalent border dimension 286.

The portion of the border portion height 284 of the front side 280 has a base border color 288. The base border color 288 matches the border color 24 for defining a matching color 290. The equivalent border dimension 286 and the matching color 290 create an unaltered image 292 of the channel marker 20 with the illuminating device 10 engaging with the channel marker 20.

As shown in FIG. 2, a single illuminating device 10 may be utilized on the upper edge of the square channel marker. Alternatively, as shown in FIG. 3 a plurality of illuminating devices 10 may be utilized on more than one edge of the channel marker for providing additional illumination of the channel marker. The illuminating device 10 may be highly advantageous for permitting operators of a vessel 30 traversing through the water 32 in locating and viewing the channel markers 20 and the marker symbols 28 during the evening hours.

Specifically to the second embodiment in FIGS. 10-12, 14 and 16, the second upper track defines a second offset orientation 300 relative to the mounting channel 72. The upper track 140 and the second upper track 160 define opposite orientations. More specifically, the first offset orientation 270 and the second offset orientation 300 are equivalent for defining a symmetrical cross-section 304 in the base 60.

In addition, the second embodiment includes a second lower track 310 coupled to the base 60 and has a generally descending orientation 312. Preferably, second lower track 310 defining a generally C-shape cross-section 314. More specifically, the general C-shape cross-section 314 of the second lower track 310 includes a primary arm 316 and a secondary arm 318 that is coupled by a track wall 149.

A second light illuminating device 320 is removably engaged within the second lower track 310. The second light illuminating device 320 preferably has an elongated configuration 322 for extending between the proximal end 62 and the distal end 64 of the base 60. More specifically, the second light illuminating device 320 engages within the general C-shaped cross-section 314 wherein the primary arm 316 and the secondary arm 318 of the second lower track 310 maintains the second light illuminating device 320 adjacent to the track wall 319. The second light illuminating device 320 can be easily installed or easily replaced if damaged by having the second light illuminating device 320 being removably engaged within the second lower track 310. The second light illuminating device 320 includes a plurality of linear light emitting diodes 324 or other illuminating devices. The second light illuminating device 320 projects an electromagnetic radiation 196 in a generally descending orientation 198 for illuminating the object 14, including the rear side of the advertising sign 40 as shown in FIG. 10.

As best shown in FIG. 11, the electrical interface 112 includes a fourth electrical receptacle 216. A fourth electrical conduit 226 extends from the second light illuminating device 320 and terminates with a fourth electrical plug 236.

The fourth electrical conduit 226 electrically couples the power source 100 with the second light illuminating device 320 for supplying current to the second light illuminating device 320. The fourth electrical plug 236 engages into the fourth electrical receptacle 216 for permitting prompt coupling and decoupling of the power source 100 with the second light illuminating device 320. Preferably, the engagement between the fourth electrical receptacle 216 with the fourth electrical plug 236 form a watertight engagement including but not limited to a rubber boot engagement.

As best shown in FIG. 11, the lower track 150 defines a third offset orientation 340 relative to the mounting channel 72. The second lower track 310 defines a fourth offset orientation 342 relative to the mounting channel 72. The lower track 150 and the second lower track 310 define converging orientations 344. The third offset orientation 340 and the fourth offset orientation 342 are equivalent for defining a symmetrical cross-section 346 in the base 60.

As also best shown in FIG. 11, the upper track 140 and the second upper track 160 define a generally upper obtuse angle 350 there between. The lower track 150 and the second lower track 310 define a generally lower obtuse angle 352 there between. The base 60 includes a first sidewall 360 and a second sidewall 362 having a generally parallel orientation relative 364 to the first mounting leg 66 and the second mounting leg 68. The first sidewall 360 and the second sidewall 362 define opposite and opposing orientations 366. A first reflective layer 370 is coupled to the first sidewall 360 for reflecting a foreign electromagnetic radiation. A second reflective layer 372 is coupled to the second sidewall 362 for reflecting a foreign electromagnetic radiation. The foreign electromagnetic radiation may be generated from a headlight from a motor vehicle, a flashlight or other light illuminating devices.

As best shown in FIG. 10, the second embodiment of the illuminating device 10 may utilized on the upper edge of the sign 40. More specifically, the second embodiment may be most useful in a two-sided sign 42 wherein illumination is needed on a first sign side 380 and a second sign side 382. The illuminating device 10 may be highly advantageous for permitting individuals to view either the first sign side 380 or the second sign side 382 during the evening hours.

FIGS. 17-24 illustrate a third embodiment of the subject invention. In FIGS. 17-24 the illuminating device 10 illuminates a water platform 400, a body of water 32, and/or a vessel 30 located adjacent to the water platform 400. The water platform 400 may include a floating dock 402, a vertical column supported dock 402, or other objects positioned on, above and/or adjacent to a body of water 32. The water platform 400 may include a horizontal deck portion 404 and a vertical freeboard portion 406. The vessel 30 may be positioned adjacent to the water platform 400 for docking.

Similar to FIGS. 1-16, the illuminating device 10 in FIGS. 17-24 includes a base 60 extending between a proximal end 62 and a distal end 64. FIGS. 17-24 include a first mounting leg 410 extending from the base 60 in a generally vertical orientation 412. A second mounting leg 414 extends from the base 60 in a generally horizontal orientation 416. A L-shaped mounting channel 420 defined between the first mounting leg 410, the base 60 and the second mounting leg 414 for abutting the vertical freeboard portion 406 and the horizontal deck portion 404 respectively. The first mounting leg 410 and the second mounting leg 68 may be further secured to the object 14 by fasteners, adhesive or other coupling devices.

The base 60 further includes a base channel 90. Preferably, the base channel 90 extends between the proximal end 62 and the distal end 64 of the base 60. The base channel 90 defines a proximal aperture 92 and a distal aperture 94. The base channel 90 is shown as including a rectangular shaped cross-section 96. However, the base channel 90 may include other geometric cross-sectional shapes.

As shown in FIGS. 19-22, a power source 100 is removably engaged within the base channel 90. The power source 100 is preferably constructed of an elongated housing 102 having a rectangular shaped cross-section 104 and extending between a proximal end 106 and a distal end 108. The distal end 108 of the elongated housing 102 includes a sealed enclosure 110. The proximal end 106 of the elongated housing 102 includes an electrical interface 112. Preferably, the rectangular shaped cross-section 104 of the power source 100 is commensurate to the rectangular shaped cross-section 96 of the base channel 90 for preventing rotational displacement of the elongated housing 102 relative to the base channel 90. The elongated housing 102 may be contracted of a polymeric material or other noncorrosive materials. The elongated housing 102 includes an upper surface 114 having a plurality of ripped casting 116 for abutting against an upper surface 98 of the base channel 90. The plurality of ripped casting 116 prevent the inadvertent linear displacement of the elongated housing 102 from the base channel 90. The power source 100 can be easily installed or easily replaced if damaged by having the power source 100 being removably engaged within the base channel 90.

Internal to the elongated housing 102 is a battery chamber 120 for receiving a plurality of rechargeable batteries 122. An electrical circuit 124 couples the plurality of rechargeable batteries 122 to a circuit board 126 and to the electrical interface 112.

An upper track 140 is coupled to the base 60. The upper track 140 has a generally ascending orientation 142. A lower track 150 is coupled to the first mounting leg 410 and has a generally descending orientation 152. Preferably, the upper track 140 and the lower track 150 defining a generally C-shape cross-section 144 and 154, respectively. More specifically, the general C-shape cross-section 144 of the upper track 140 includes a primary arm 146 and a secondary arm 148 that is coupled by a track wall 149. The general C-shaped cross-section 154 of the lower track 150 includes a primary arm 156 and a secondary arm 158 that is coupled by a track wall 159.

A solar panel 170 is removably engaged within the upper track 140. The solar panel 170 preferably has an elongated configuration 172 for extending between the proximal end 62 and the distal end 64 of the base 60. More specifically, the solar panel 170 engages within the general C-shaped cross-section 144 wherein the primary arm 146 and the secondary arm 148 of the upper track 140 maintains the solar panel 170 adjacent to the track wall 149. The solar panel 170 can be easily installed or easily replaced if damaged by having the solar panel 170 being removably engaged within the upper track 140.

A light illuminating device 190 is removably engaged within the lower track 150. The light illuminating device 190 preferably has an elongated configuration 192 for extending between the proximal end 62 and the distal end 64 of the base 60. More specifically, the light illuminating device 190 engages within the general C-shaped cross-section 154 wherein the primary arm 156 and the secondary arm 158 of the lower track 150 maintains the light illuminating device 190 adjacent to the track wall 159. The light illuminating device 190 can be easily installed or easily replaced if damaged by having the light illuminating device 190 being removably engaged within the lower track 150. The light illuminating device 190 includes a plurality of linear light emitting diodes 194 or other illuminating devices. The light illuminating device 190 projects an electromagnetic radiation 196 in a generally descending orientation 198 for illuminating the water platform 400, a body of water 32, and/or a vessel 30 located adjacent to the water platform 400.

Figure 19:
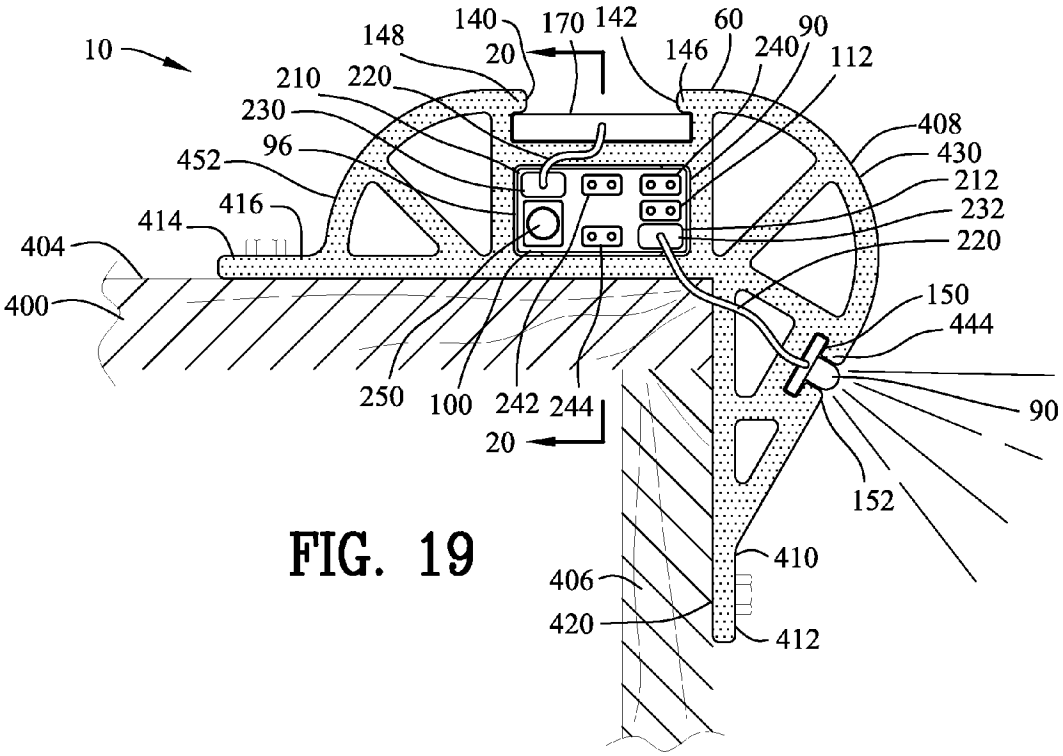
FIG. 19 is an enlarged end view of FIG. 18.
Figure 20:
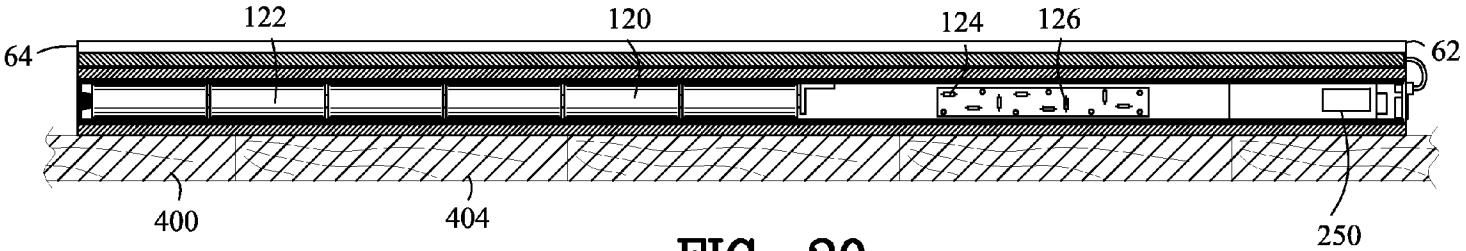
FIG. 20 is a sectional view along line 20-20 in FIG. 19.
Figure 21:
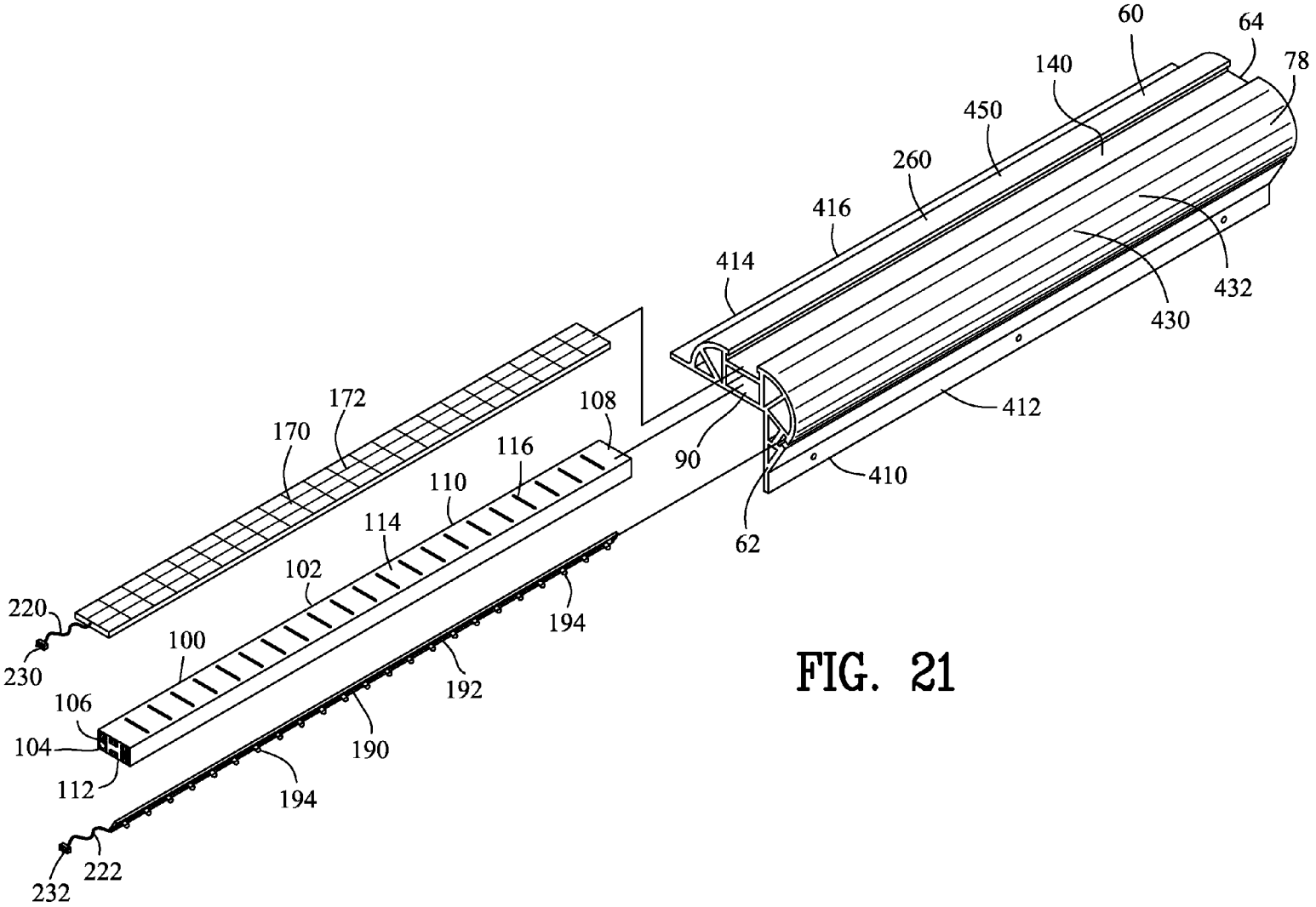
FIG. 21 is an exploded isometric view of the illuminating device of FIG. 19.
Figure 22:
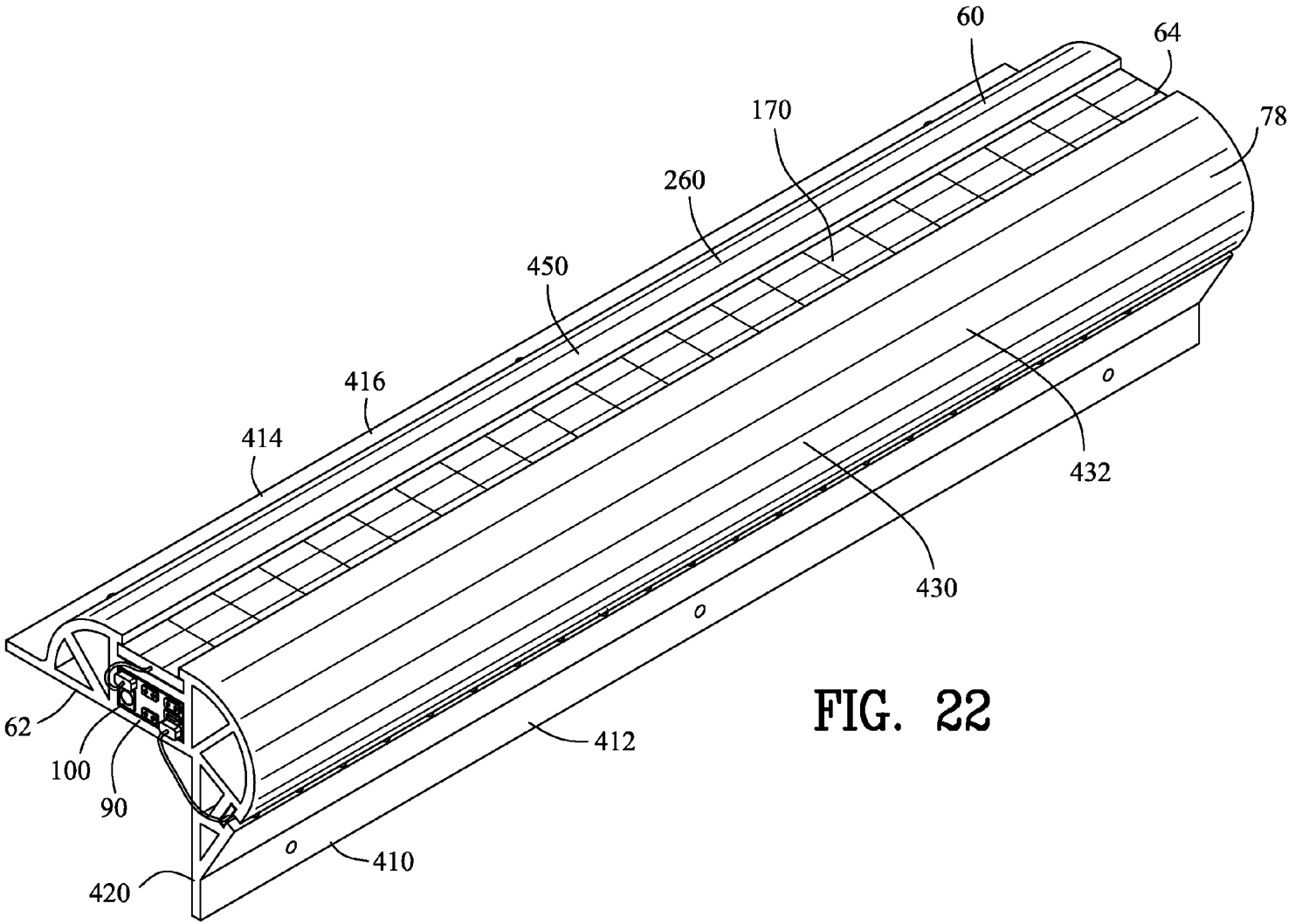
FIG. 22 is a view similar to FIG. 21 illustrating a power source, a solar panel and a light illuminating device engaging within a base channel, an upper track and a lower track respectively.

As best shown in FIGS. 19 and 22, the electrical interface 112 includes a first electrical receptacle 210 and a second electrical receptacle 212. A first electrical conduit 220 extends from the solar panel 170 and terminates with a first electrical plug power source 230. A second electrical conduit 222 extends from the light illuminating device 190 and terminates with a second electrical plug 232.

The first electrical conduit 220 electrically couples the power source 100 with the solar panel 170 for recharging the plurality of rechargeable batteries 122. The first electrical plug 230 engages into the first electrical receptacle 210 for permitting prompt coupling and decoupling of the power source 100 with the solar panel 170. The second electrical conduit 222 electrically couples the power source 100 with the light illuminating device 190 for supplying current to the light illuminating device 190. The second electrical plug 232 engages into the second electrical receptacle 212 for permitting prompt coupling and decoupling of the power source 100 with the light illuminating device 190. Preferably, the engagement between the first electrical receptacle 210 with the first electrical plug 230 and between the second electrical receptacle 212 with the second electrical plug 232 form a watertight engagement including but not limited to a rubber boot engagement.

The electrical interface 112 may further include a battery contact initiator receptacle 240 and a battery contact initiator plug 242. The battery contact initiator plug 242 would be stored in a non-functional receptacle 244 during storage and transportation for placing the electrical circuit 224 in an open circuit status. Upon the desire to initiate the illuminating device 10, the battery contact initiator plug 242 would be withdrawn from the nonfunctional receptacle 244 and installed into the battery contact initiator receptacle 240 for placing the electrical circuit 224 in a closed circuit status.

The elongated housing 102 may further include a photoelectric switch 250 that is electrically coupled to the electrical circuit 124. More specifically, the photoelectric switch 250 may be coupled within the second electrical conduit 222 for terminating current to the light illuminating device 190 when the photoelectric switch 250 is exposed to sunlight and permitting current to the light illuminating device 190 when the photoelectric switch 250 is not exposed to sunlight.

Figure 23:
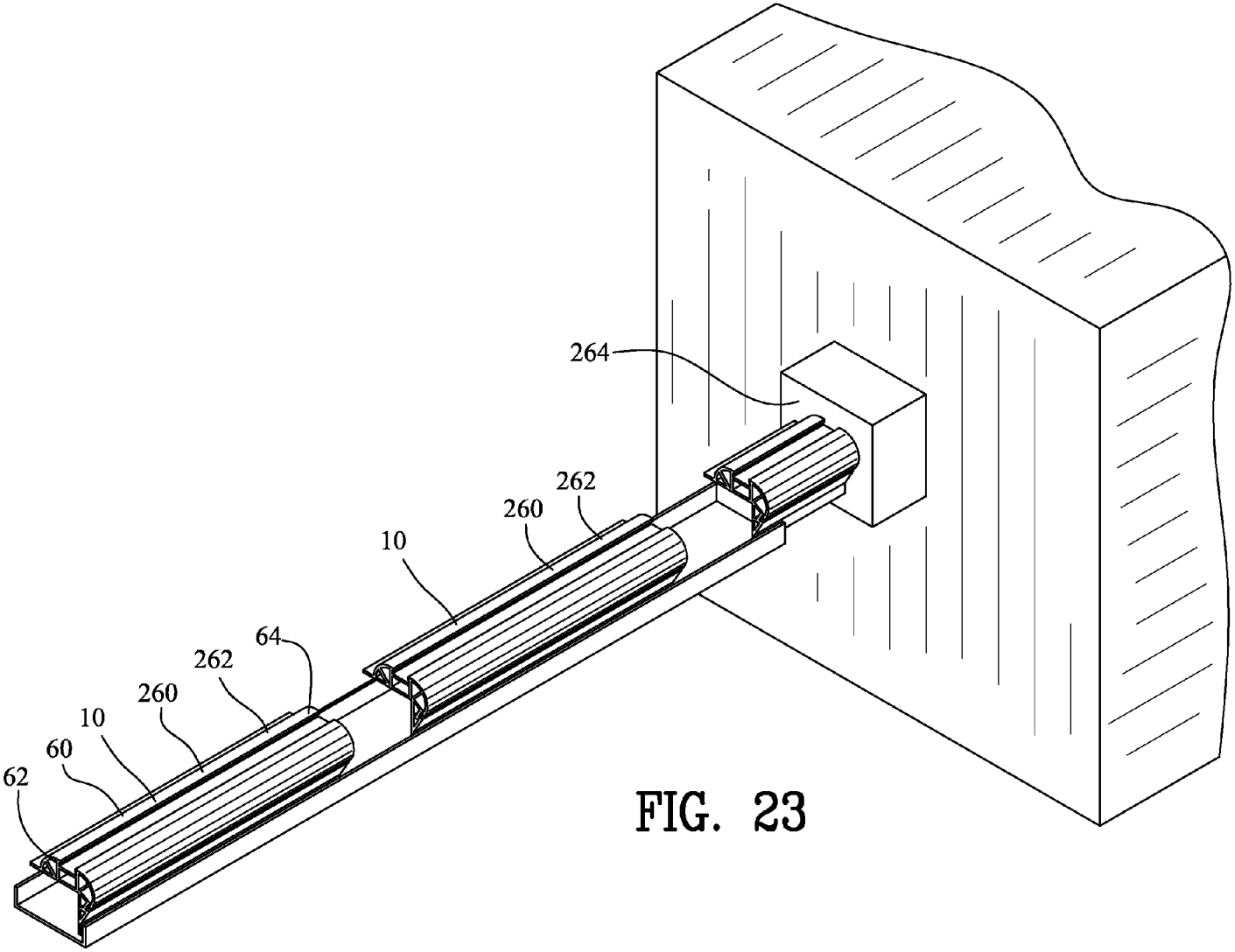
FIG. 23 is an isometric view of the illuminating device of FIG. 19 being constructed from an integral one-piece unit by extruding a polymeric material through a mold.
Figure 24:
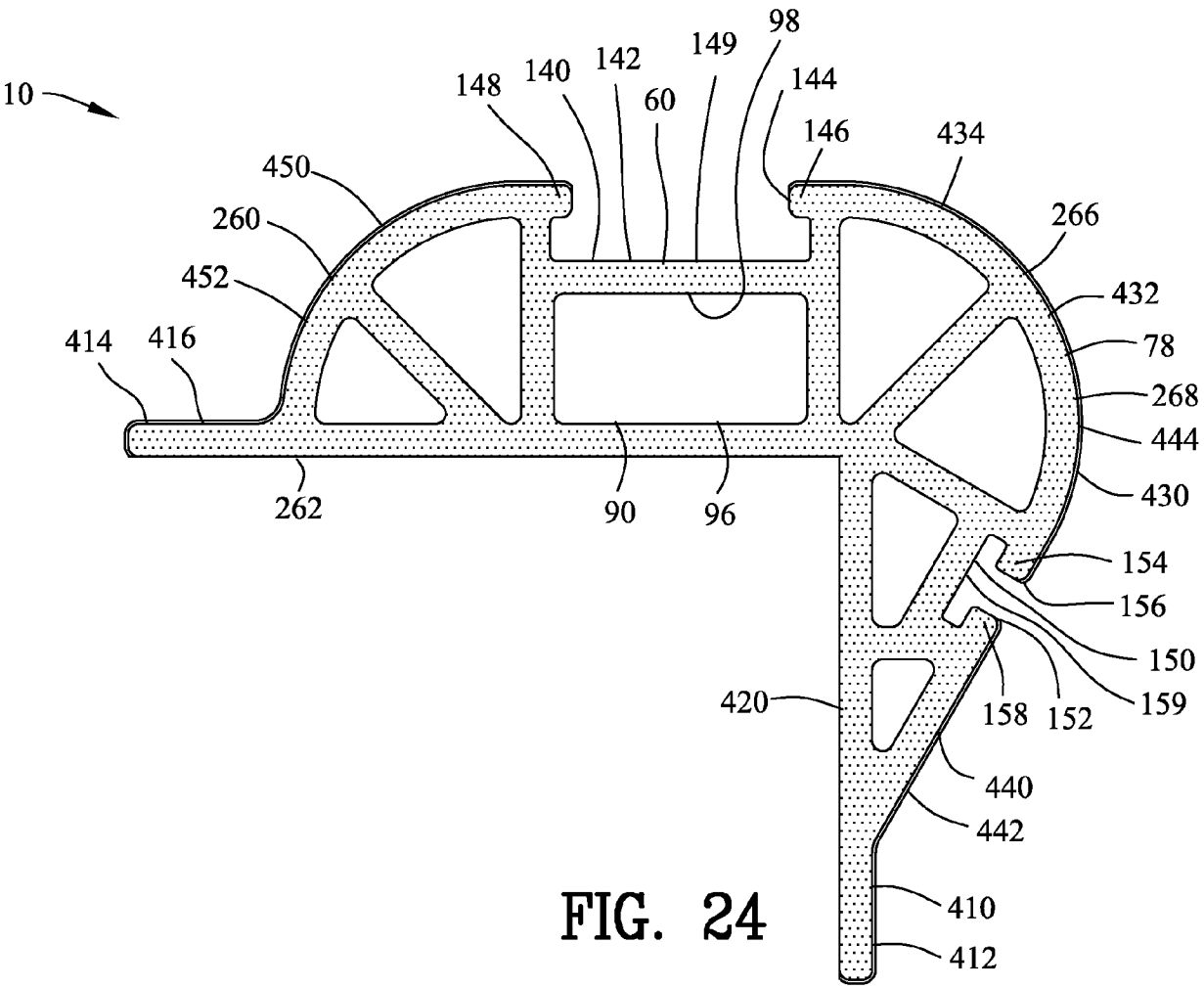
FIG. 24 is a view similar to FIG. 19 illustrating the third illuminating device including a protective layer.

The best shown in FIG. 23, the base 60, the first mounting leg 410, the second mounting leg 414, the upper track 140 and the lower track 150 are constructed from an integral one-piece unit 260. The integral one-piece unit 260 may be constructed by extruding a polymeric material 262 through a mold 264. Preferably, the polymeric material 262 should be selected such that the illuminating device 10 is permitted to slightly bend, twist and compress. Furthermore, by extruding the illuminating device 10 through the mold 264, the illuminating device 10 is able have alternative overall lengths. As shown in FIG. 24 the base 60 may include a protective coating 266. The protective coating 266 protects the interior polymeric material 262 from deterioration from UV rays and other physical and environmental factors. The protective coating 266 may include a white pigment 268 for reflecting UV rays.

Figure 17:
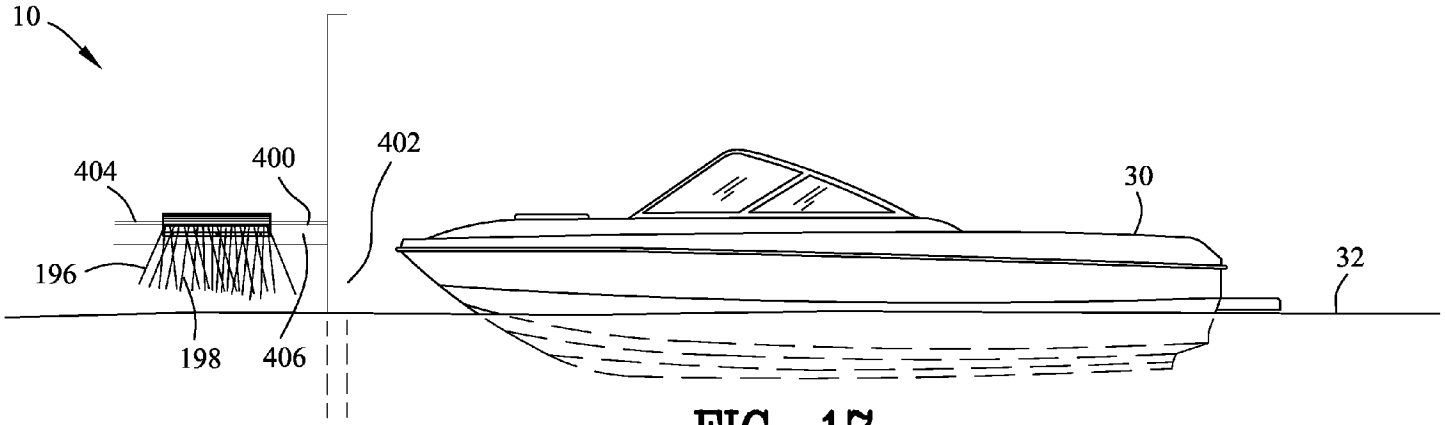
FIG. 17 is an elevated view of a third embodiment for an illuminating device for illuminating a water platform and body of water and serve as a platform bumper.
Figure 18:
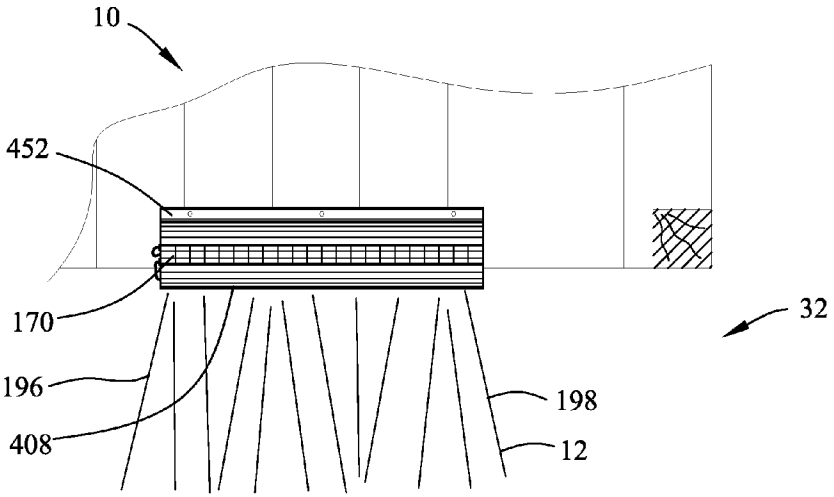
FIG. 18 is a top view of a portion of FIG. 17.

As shown in FIGS. 17 and 18, a single illuminating device 10 may be utilized on the water platform 400. Alternatively, a plurality of illuminating devices 10 may be utilized abutting one another to form a continuous and elongated illuminating strip for providing a continuous and elongated illumination. The illuminating device 10 may be highly advantageous for permitting operators of the vessel 30 in viewing the water platform and/or the water 32 in low light environments. The illuminating device 10 may be also highly advantageous by defining a water platform bumper 408 at the edge of the water platform 400. The water platform bumper 408 would assist in preventing a foot of the individual from being positioned beyond the vertical freeboard portion 406 and thus prevent an individual from falling into the water 32 in high and low light environments. In addition, the illuminating device of FIGS. 17-24 may be advantageous by creating a decorative illumination onto the water 32.

The illuminating device 10 in FIGS. 17-24 further includes a deformable bumper 430 extending from the base 60 for cushioning and distancing the vessel 30 from water platform 400. The deformable bumper 430 includes a bulbous body portion 432. The bulbous body portion 432 has a bulbous depth 434. A taper body portion 440 extends from the first mounting leg 410. The taper body portion 440 has a taper depth 442. The bulbous depth 434 is greater than the taper depth 442 for defining a cantilever 444 in the bulbous body portion 432 relative to the taper body portion 440. The lower track 150 is coupled to the taper body portion 440. The cantilever 444 protects the light illuminating device 190 upon the vessel 30 contacting the bulbous body portion 432.

An arcuate body portion 450 extends from both the base 60 and the second mounting leg 414. The arcuate body portion 450 defines a foot rail 452 on the horizontal deck portion 404 and adjacent to the vertical deck portion 406. The base 60, the deformable bumper 430 and or the arcuate body portion 450 may include a reflective layer 78 for reflecting a foreign electromagnetic radiation. The foreign electromagnetic radiation may be generated from a spotlight from a vessel, a flashlight or other light illuminating devices.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An illuminating device, comprising:

a base extending between a proximal end and a distal end;

a first mounting leg and a second mounting leg extending from said base in a generally descending orientation;

a mounting channel defined between said first mounting leg and said second mounting leg for positioning on opposing sides of an object;

a base channel defined in said base;

a power source being removably engaged within said base channel;

an upper track coupled to said base and having a generally ascending orientation;

a solar panel being removably engaged within said upper track;

a first electrical conduit electrically coupling said power source with said solar panel for recharging said power source;

a lower track coupled to said base and having a generally descending orientation;

a light illuminating device being removably engaged within said lower track;

a second electrical conduit electrically coupling said power source with said light illuminating device for supplying current to said light illuminating device; and said light illuminating device projecting an electromagnetic radiation in a generally descending orientation.

2. An illuminating device as set forth in claim 1, wherein said upper track and said lower track defining a general C-shape;

said general C-shape including a primary arm and a secondary arm coupled by a track wall;

said primary arm and said secondary arm of said upper track maintaining said solar panel adjacent to said track wall; and said primary arm and said secondary arm of said lower track maintaining said light illuminating device adjacent to said track wall.

3. An illuminating device as set forth in claim 1, wherein said light illuminating device includes a plurality of linear light emitting diodes.

4. An illuminating device as set forth in claim 1, further including a first electrical receptacle coupled to said power source;

a first electrical plug coupled to said first electrical conduit;

said first electrical plug engaging into said first electrical receptacle for permitting prompt coupling and decoupling of said power source with said solar panel;

a second electrical receptacle coupled to said power source;

a second electrical plug coupled to said second electrical conduit;

said second electrical plug engaging into said second electrical receptacle for permitting prompt coupling and decoupling of said power source with said light illuminating device.

5. An illuminating device as set forth in claim 1, further including a photoelectric switch within said second electrical conduit for terminating current to said light illuminating device when said photoelectric switch is exposed to sunlight and permitting current to said light illuminating device when said photoelectric switch is not exposed to sunlight.

6. An illuminating device as set forth in claim 1, wherein said upper track defines an offset orientation relative to said mounting channel;

a second upper track coupled to said base and having a generally ascending orientation;

said second upper track defining a non-offset orientation relative to said mounting channel;

a second solar panel being removably engaged within said second upper track; and a third electrical conduit electrically coupling said power source with said second solar panel for recharging said power source.

7. An illuminating device as set forth in claim 1, wherein said upper track defines a first offset orientation relative to said mounting channel;

a second upper track coupled to said base and having an generally ascending orientation;

said second upper track defining a second offset orientation relative to said mounting channel;

said upper track and said second upper track defining opposite orientations; and said first offset orientation and said second offset orientation being equivalent for defining a symmetrical cross-section in said base.

8. An illuminating device as set forth in claim 7, further including a second lower track coupled to said base and having a generally descending orientation;

a second light illuminating device being removably engaged within said second lower track;

a fourth electrical conduit electrically coupling said power source with said second light illuminating device for supplying current to said second light illuminating device; and said second light illuminating device projecting an electromagnetic radiation in a generally descending orientation.

9. An illuminating device as set forth in claim 7, further including a second lower track coupled to said base and having a generally descending orientation;

a second light illuminating device being removably engaged within said second lower track;

a fourth electrical conduit electrically coupling said power source with said second light illuminating device for supplying current to said second light illuminating device;

said second light illuminating device projecting an electromagnetic radiation in a generally descending orientation;

said lower track defines a third offset orientation relative to said mounting channel;

said second lower track defining a fourth offset orientation relative to said mounting channel;

said lower track and said second lower track defining converging orientations; and said third offset orientation and said fourth offset orientation being equivalent for defining a symmetrical cross-section in said base.

10. An illuminating device as set forth in claim 9, wherein said upper track and said second upper track defining a generally upper obtuse angle there between; and said lower track and said second lower track defining a generally lower obtuse angle there between.

11. An illuminating device as set forth in claim 1, wherein said base, said first mounting leg, said second mounting leg, said upper track and said lower track being constructed from a integral one-piece unit; and said integral one-piece unit constructed by extruding a polymeric material through a mold.

12. An illuminating device as set forth in claim 1, wherein said base includes a sidewall having a generally parallel orientation relative to said first mounting leg and said second mounting leg; and a reflective layer coupled to said sidewall for reflecting a foreign electromagnetic radiation.

13. An illuminating device as set forth in claim 7, wherein said base includes a first sidewall and a second sidewall having a generally parallel orientation relative to said first mounting leg and said second mounting leg;

said first sidewall and said second sidewall defining opposite and opposing orientations;

a first reflective layer coupled to said first sidewall for reflecting a foreign electromagnetic radiation; and a second reflective layer couple to said second sidewall for reflecting a foreign electromagnetic radiation.

14. An illuminating device as set forth in claim 1, further including a bird deterrent spike extending from said base and having a generally vertical orientation.

15. An illuminating device for illuminating a channel marker, the illuminating device, comprising:

a base extending between a proximal end and a distal end;

a first mounting leg and a second mounting leg extending from said base in a generally descending orientation;

a mounting channel defined between said first mounting leg and said second mounting leg for positioning on opposing sides of the channel marker;

a base channel defined in said base;

a power source being removably engaged within said base channel;

and an upper track coupled to said base and having a generally ascending orientation;

a solar panel being removably engaged within said upper track;

a first electrical conduit electrically coupling said power source with said solar panel for recharging said power source;

a lower track coupled to said base and having a generally descending orientation;

a light illuminating device being removably engaged within said lower track;

a second electrical conduit electrically coupling said power source with said light illuminating device for supplying current to said light illuminating device; and said light illuminating device projecting an electromagnetic radiation in a generally descending orientation on to the channel marker.

16. An illuminating device for illuminating a channel marker, the channel marker having a interior color and a border color, the border color having a border width, the illuminating device, comprising:

a base extending between a proximal end and a distal end and having a front side and a rear side;

a first mounting leg and a second mounting leg extending from said base in a generally descending orientation;

a mounting channel defined between said first mounting leg and said second mounting leg for positioning on opposing sides of the channel marker;

a base channel defined in said base;

a power source being removably engaged within said base channel;

and an upper track coupled to said base and having a generally ascending orientation;

a solar panel being removably engaged within said upper track;

a first electrical conduit electrically coupling said power source with said solar panel for recharging said power source;

a lower track coupled to said base and having a generally descending orientation;

a light illuminating device being removably engaged within said lower track;

a second electrical conduit electrically coupling said power source with said light illuminating device for supplying current to said light illuminating device;

said light illuminating device projecting an electromagnetic radiation in a generally descending orientation and illuminating the channel marker;

said front side of said base having a border portion height;

said border portion height being equivalent to the border width of the channel marker for defining a equivalent border dimension;

said border portion height of said front side of said base portion having a base border color;

said base border color matching the border color for defining a matching color; and said equivalent border dimension and said matching color creating an unaltered image of the channel marker with said base engaged with the channel marker.

17. An illuminating device for illuminating a channel marker as set forth in claim 16, wherein said base includes a side wall having a generally parallel orientation relative to said first mounting leg and said second mounting leg; and a reflective layer coupled to said sidewall for reflecting a foreign electromagnetic radiation.

18. An illuminating device, comprising:

a base extending between a proximal end and a distal end;

a first mounting leg extending from said base in a generally vertical orientation;

a second mounting leg extending from said base in a generally horizontal orientation;

a mounting channel defined between said first mounting leg and said second mounting leg;

a base channel defined in said base;

a power source being removably engaged within said base channel;

an upper track coupled to said base and having a generally ascending orientation;

a solar panel being removably engaged within said upper track;

a first electrical conduit electrically coupling said power source with said solar panel for recharging said power source;

a lower track coupled to said first mounting leg and having a generally descending orientation;

a light illuminating device being removably engaged within said lower track;

a second electrical conduit electrically coupling said power source with said light illuminating device for supplying current to said light illuminating device; and said light illuminating device projecting an electromagnetic radiation in a generally descending orientation.

19. An illuminating device as set forth in claim 18, wherein said upper track and said lower track defining a general C-shape;

said general C-shape including a primary arm and a secondary arm coupled by a track wall;

said primary arm and said secondary arm of said upper track maintaining said solar panel adjacent to said track wall; and said primary arm and said secondary arm of said lower track maintaining said light illuminating device adjacent to said track wall.

20. An illuminating device as set forth in claim 18, wherein said light illuminating device includes a plurality of linear light emitting diodes.

21. An illuminating device as set forth in claim 18, further including a first electrical receptacle coupled to said power source;

a first electrical plug coupled to said first electrical conduit;

said first electrical plug engaging into said first electrical receptacle for permitting prompt coupling and decoupling of said power source with said solar panel;

a second electrical receptacle coupled to said power source;

a second electrical plug coupled to said second electrical conduit;

said second electrical plug engaging into said second electrical receptacle for permitting prompt coupling and decoupling of said power source with said light illuminating device.

22. An illuminating device as set forth in claim 18, further including a photoelectric switch within said second electrical conduit for terminating current to said light illuminating device when said photoelectric switch is exposed to sunlight and permitting current to said light illuminating device when said photoelectric switch is not exposed to sunlight.

23. An illuminating device as set forth in claim 18, wherein said base, said first mounting leg, said second mounting leg, said upper track and said lower track being constructed from a integral one-piece unit; and said integral one-piece unit constructed by extruding a polymeric material through a mold.

24. An illuminating device as set forth in claim 18, wherein said base includes a reflective layer for reflecting a foreign electromagnetic radiation.

25. An illuminating device for illuminating a water platform and body of water, the water platform having a horizontal deck portion and a vertical freeboard portion, a vessel being positioned adjacent to said water platform, the illuminating device, comprising:

a base extending between a proximal end and a distal end;

a first mounting leg extending from said base in a generally vertical orientation;

a second mounting leg extending from said base in a generally horizontal orientation;

a L-shaped mounting channel defined between said first mounting leg, said base and said second mounting leg for abutting said vertical freeboard portion and said horizontal deck portion respectively;

a base channel defined in said base;

a power source being removably engaged within said base channel;

an upper track coupled to said base and having a generally ascending orientation;

a solar panel being removably engaged within said upper track;

a first electrical conduit electrically coupling said power source with said solar panel for recharging said power source;

a lower track coupled to said first mounting leg and having a generally descending orientation;

a light illuminating device being removably engaged within said lower track;

a second electrical conduit electrically coupling said power source with said light illuminating device for supplying current to said light illuminating device;

said light illuminating device projecting an electromagnetic radiation in a generally descending orientation; and a deformable bumper extending from said base for cushioning and distancing the vessel from water platform.

26. An illuminating device for illuminating a water platform and body of water as set forth in claim 25, wherein said deformable bumper includes a bulbous body portion;

said bulbous body portion having a bulbous depth;

a taper body portion extending from said first mounting leg;

said taper body portion having a taper depth;

said bulbous depth being greater than said taper depth for defining a cantilever in said bulbous body portion relative to said taper body portion;

said lower track coupled to said taper body portion; and said cantilever protecting said light illuminating device upon the vessel contacting said bulbous body portion.

27. An illuminating device for illuminating a water platform and body of water as set forth in claim 25, further including an arcuate body portion extending from said base and said second mounting leg; and said arcuate body defining a foot rail on the horizontal deck portion and adjacent to the vertical deck portion.

28. An illuminating device for illuminating a water platform and body of water as set forth in claim 25, wherein said bumper includes a bulbous body portion;

said bulbous body portion having a bulbous depth;

a taper body portion extending from said first mounting leg;

said taper body portion having a taper depth;

said bulbous depth being greater than said taper depth for defining a cantilever in said bulbous body portion relative to said taper body portion;

said lower track coupled to said taper body portion;

said cantilever protecting said light illuminating device upon the vessel contacting said bulbous body portion;

an arcuate body portion extending from said base and said second mounting leg;

said arcuate body portion defining a foot rail on the horizontal deck portion and adjacent to the vertical deck portion;

said upper track and said lower track defining a general C-shape;

said general C-shape including a primary arm and a secondary arm coupled by a track wall;

said primary arm and said secondary arm of said upper track maintaining said solar panel adjacent to said track wall; and said primary arm and said secondary arm of said lower track maintaining said light illuminating device adjacent to said track wall.

* * * * *